US012733702B2

(12) United States Patent
FitzGerald et al.

(10) Patent No.: US 12,733,702 B2
(45) Date of Patent: Sep. 15, 2026

(54) CUT RESISTANT GLOVE

(71) Applicant: Mechanix Wear LLC, Valencia, CA (US)

(72) Inventors: Thomas Barry FitzGerald, Simi Valley, CA (US); Lloyd Champagne, Valencia, CA (US)

(73) Assignee: MECHANIX WEAR LLC, Valencia, CA (US)

( * ) Notice: Subject to any disclaimer, the term of this patent is extended or adjusted under 35 U.S.C. 154(b) by 60 days.

(21) Appl. No.: 17/800,324

(22) PCT Filed: Feb. 16, 2021

(86) PCT No.: PCT/US2021/108253

§ 371 (c)(1),
(2) Date: Aug. 17, 2022

(87) PCT Pub. No.: WO2021/167909

PCT Pub. Date: Aug. 26, 2021

(65) Prior Publication Data

US 2023/0064784 A1 Mar. 2, 2023

Related U.S. Application Data

(60) Provisional application No. 62/977,530, filed on Feb. 17, 2020.

(51) Int. Cl.
*A41D 19/015* (2006.01)

(52) U.S. Cl.
CPC . *A41D 19/01505* (2013.01); *A41D 19/01576* (2013.01); *A41D 19/01588* (2013.01)

(58) Field of Classification Search
CPC ..... A41D 19/01505; A41D 19/01558; A41D 19/01576; A41D 19/01588; A41D 19/01547; A41D 19/01564
See application file for complete search history.

(56) References Cited

U.S. PATENT DOCUMENTS 2,167,226 A * 7/1939 Wells ..... A41D 19/01547 2/168
4,525,877 A * 7/1985 Chong ..... A41D 19/01576 2/163
4,675,914 A * 6/1987 Mitchell ..... A41D 19/01588 2/161.1
5,187,815 A * 2/1993 Stern ..... A61B 42/00 2/167
5,231,700 A * 8/1993 Cutshall ..... A61B 42/10 2/167
5,745,919 A * 5/1998 Kraatz ..... A41D 19/01505 2/163

(Continued)

*Primary Examiner* — Heather Mangine
(74) *Attorney, Agent, or Firm* — VENABLE LLP

(57) ABSTRACT

A glove for protecting a hand of a user includes a main glove body configured to receive metacarpals of the hand and a glove thumb coupled to the main glove body and extending longitudinally away from the main glove body. The glove thumb is configured to receive a thumb of the hand. The glove thumb includes a thumb panel extending longitudinally along a length of the glove thumb. The thumb panel forms a first pleat raised above an outer surface of the thumb panel. The first pleat extends longitudinally along the length of the glove thumb.

16 Claims, 20 Drawing Sheets

(56) References Cited

U.S. PATENT DOCUMENTS 6,044,494 A * 4/2000 Kang ..... A41D 19/01558 2/161.3
6,427,249 B1 * 8/2002 Mattesky ..... A41D 19/01505 2/161.6
D621,552 S * 8/2010 Fitzgerald ..... D29/113
D621,553 S * 8/2010 Fitzgerald ..... D29/113
D625,051 S * 10/2010 Fitzgerald ..... D29/113
9,642,405 B2 * 5/2017 Safford ..... A41D 19/0044
10,506,836 B2 * 12/2019 Takagi ..... A41D 13/0156
D873,500 S * 1/2020 Champagne ..... D29/117.1
2003/0140396 A1 * 7/2003 Vero ..... A41D 31/24 2/167
2004/0221365 A1 * 11/2004 Fitzgerald ..... A63B 71/141 2/159
2006/0005295 A1 * 1/2006 Mattesky ..... A41D 19/0058 2/159
2006/0212990 A1 * 9/2006 Mattesky ..... A41D 19/0006 2/161.6
2007/0074331 A1 * 4/2007 Bitzer ..... A41D 19/02 2/159
2007/0150998 A1 * 7/2007 Atherton ..... A63B 71/146 2/159
2010/0186141 A1 * 7/2010 Green ..... A41D 19/02 2/163
2010/0275342 A1 * 11/2010 Sweeney ..... D04B 1/28 2/167
2013/0036523 A1 * 2/2013 Webster ..... A41D 19/01523 2/19
2013/0291282 A1 * 11/2013 Anstey ..... A41D 19/0082 2/161.7
2014/0033392 A1 * 2/2014 Bulan ..... A41D 19/01547 2/16
2014/0059739 A1 * 3/2014 Gellis ..... A41D 19/0048 2/168
2014/0215685 A1 * 8/2014 Bush ..... A63B 71/146 2/161.1
2014/0223630 A1 * 8/2014 Johnson ..... A41D 13/0015 2/69
2014/0237701 A1 * 8/2014 Thompson ..... A41D 19/01505 2/164
2015/0121605 A1 * 5/2015 Safford ..... A41D 19/01552 2/162
2015/0189932 A1 * 7/2015 Champagne ..... A61B 42/10 2/161.6
2015/0359277 A1 * 12/2015 Todorov ..... A41D 19/0006 2/16
2015/0366277 A1 * 12/2015 Rabbeth, Jr. ..... A63B 71/141 602/22
2016/0029721 A1 * 2/2016 Sheehy ..... A41D 19/015 2/16
2016/0058083 A1 * 3/2016 Palese ..... A41D 19/001 2/16
2016/0073711 A1 * 3/2016 Fitzgerald ..... A41D 19/0006 2/161.6
2017/0265540 A1 * 9/2017 Kolmes ..... A41D 19/015
2018/0049490 A1 * 2/2018 Lim ..... A41D 19/01523
2018/0303176 A1 * 10/2018 Lim ..... A41D 19/01505
2018/0310649 A1 * 11/2018 Choi ..... B32B 27/40
2019/0014838 A1 * 1/2019 Price ..... A41D 27/28
2019/0357612 A1 * 11/2019 Safford ..... A41D 19/01505
2020/0060361 A1 * 2/2020 Depriest ..... A41D 19/0024
2020/0397075 A1 * 12/2020 Iacono ..... A41D 19/01523
2021/0219637 A1 * 7/2021 Iacono ..... A41D 19/015
2021/0378335 A1 * 12/2021 Lim ..... A41D 19/01505
2023/0064784 A1 * 3/2023 FitzGerald ..... A41D 19/01505
2023/0105952 A1 * 4/2023 Aziz ..... A41D 19/0068 2/159

* cited by examiner

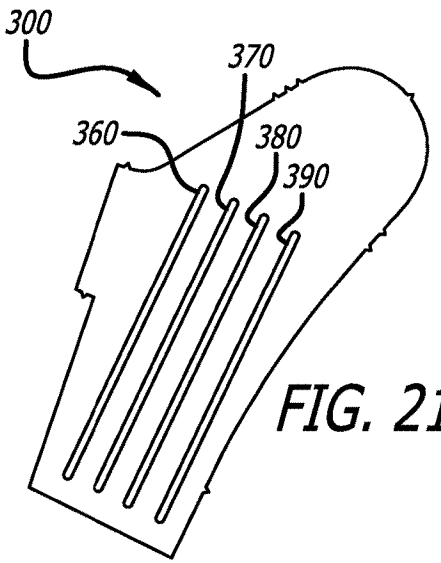
FIG. 21A
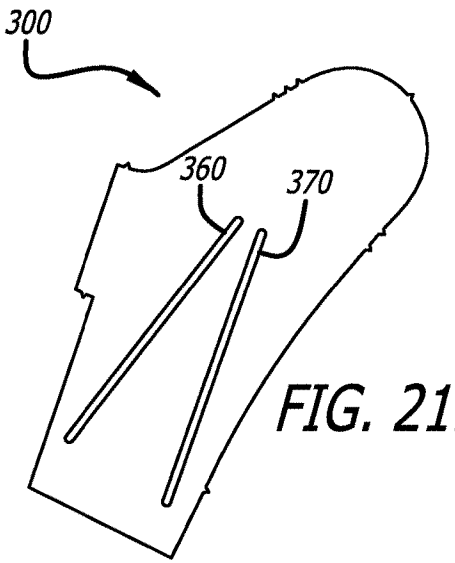
FIG. 21B
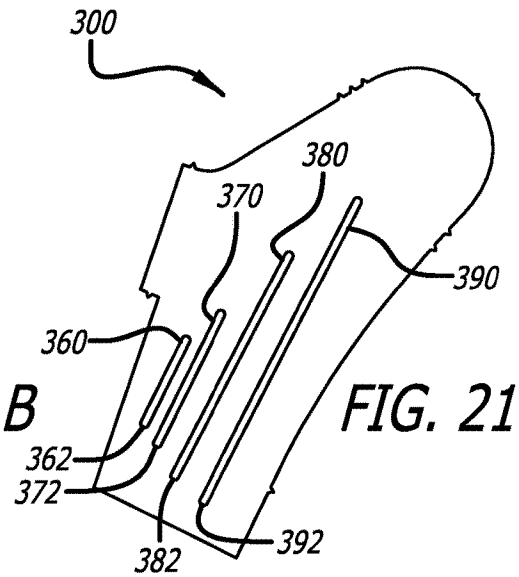
FIG. 21C
FIG. 21D
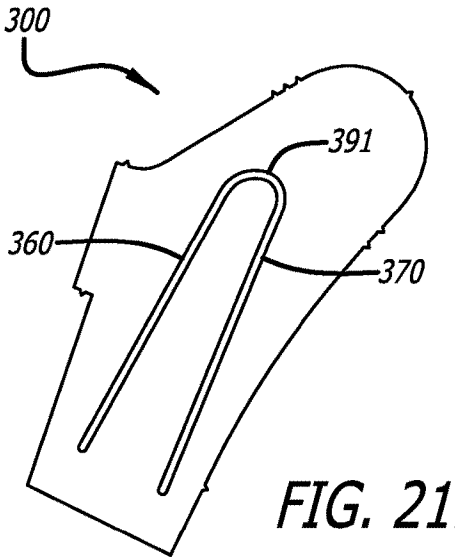
FIG. 21E
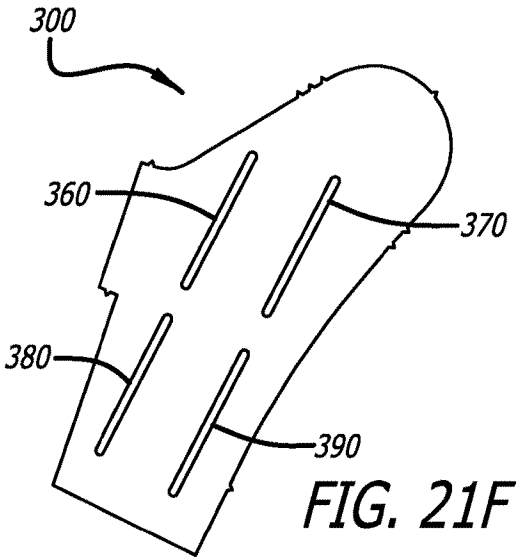
FIG. 21F

CUT RESISTANT GLOVE

CROSS-REFERENCE TO RELATED APPLICATION

The present application is a 371 of PCT/US2021/018253, filed Feb. 16, 2021, which claims the benefit of U.S. Provisional Application No. 62/977,530, filed Feb. 17, 2020, the entire contents of which is incorporated by reference herein.

BACKGROUND

The present disclosure relates generally to clothing. More specifically, the present disclosure relates to gloves.

Gloves are used to protect users' hands in a variety of applications. Gloves facilitate handling objects while preventing the users' hands from coming in direct contact with contaminants, such as dirt or rust, or potentially dangerous surfaces, such as sharp edges. When performing certain operations (e.g., opening boxes), a user's hands come in close proximity to sharp objects (e.g., box cutters, knives, scissors). This can potentially lead to hand injuries.

SUMMARY

At least one embodiment relates to a glove for protecting a hand of a user. The glove includes a main glove body configured to receive metacarpals of the hand and a glove thumb coupled to the main glove body and extending longitudinally away from the main glove body. The glove thumb is configured to receive a thumb of the hand. The glove thumb includes a thumb panel extending longitudinally along a length of the glove thumb. The thumb panel forms a first pleat raised above an outer surface of the thumb panel. The first pleat extends longitudinally along the length of the glove thumb.

Another embodiment relates to a glove for protecting a hand of a user. The glove includes a main glove body configured to receive metacarpals of the hand, and a glove thumb coupled to the main glove body and extending longitudinally away from the main glove body. The glove thumb is configured to receive a thumb of the hand and includes a thumb panel extending longitudinally along a length of the glove thumb. The main glove body includes a panel coupled to the thumb panel. The panel of the main glove body is made from a first material, and the thumb panel is made from a second material that has a greater cut resistance than the first material.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

BRIEF DESCRIPTION OF THE FIGURES

FIGS. 21A-21F are top views of a flat pattern of a thumb panel of a glove, according to various exemplary embodiments.

DETAILED DESCRIPTION

Figure 1:
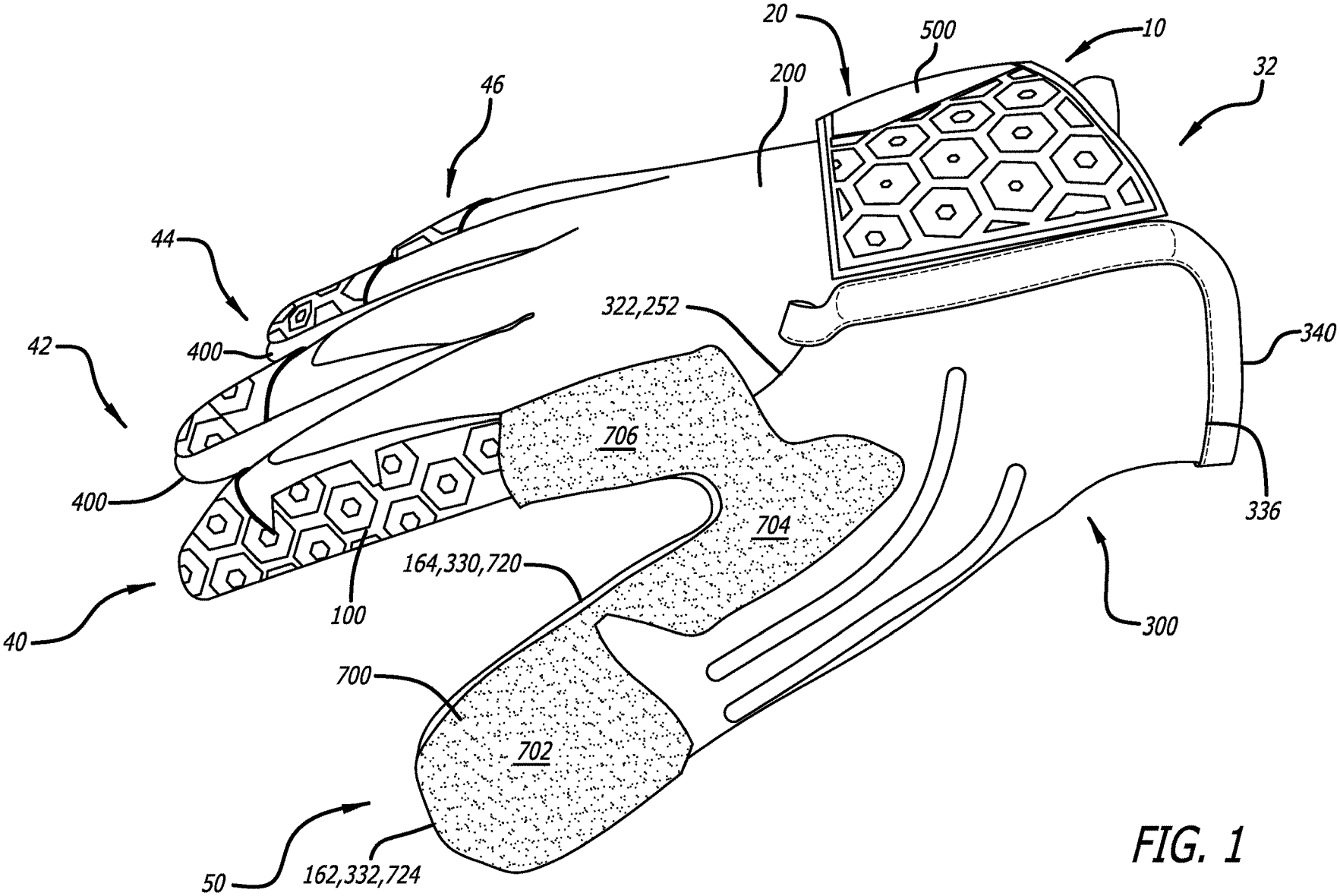
FIG. 1 is a top, left perspective view of a glove, according to an exemplary embodiment.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

When performing certain tasks that require the use of sharp objects, workers have an elevated risk of cutting their hands. By way of example, workers that remove large quantities of objects from packages, such as boxes, (e.g., warehouse workers, grocery store employees, retail employees, etc.) may frequently use knives, box cutters, scissors, or other sharpened tools to cut through cardboard, tape, or other packaging to access various products. To perform this task, a worker will frequently hold the packages with one hand while operating the sharpened tool with the other hand to open the package. This places the worker's hand in close proximity to the sharpened tool and introduces the possibility that a worker will accidentally cut their hand. Due to both (a) the prominent position of a thumb on a user's hand and (b) the way that boxes are commonly held (e.g., with a user's thumb placed along a top surface of the box), such cuts often cross the user's thumb, causing damage to the user's thumb tendon.

Referring generally to the Figures, a glove is shown including certain features that increase a resistance to cutting or other penetration of certain portions of the glove relative to traditional gloves. Specifically, a portion of the glove containing the user's thumb may have improved cut resistance. The glove includes a thumb panel made from a cut resistant material. The cut resistant material may be more resistant to cutting or other penetration by a blade or sharpened object (e.g., cutting, piercing, shearing, tearing, slicing, etc.) when experiencing contact with a sharpened object than other materials used in the glove and/or materials traditionally used in gloves. The thumb panel may extend over (e.g., cover) a thumb region of a user's hand. Specifically, the thumb panel may cover both a first portion of the thumb region containing the thumb phalanges and a second portion of the thumb region containing the thumb metacarpal. The thumb panel forms a series of pleats or ridges that extend longitudinally along a length of the thumb. The pleats extend outward from an outer surface of the thumb panel such that the sharpened object engages the pleats prior to engaging the outer surface. The pleats reduce contact between the sharpened object and the outer surface of the thumb panel, further improving a cut resistance of the glove.

Glove Structure

Referring to FIGS. 1-6, clothing or protective equipment (e.g., a glove) is shown as glove 10 according to an exemplary embodiment. Although only a right-handed glove 10 is shown, it should be understood that a left-handed glove may be provided that is substantially similar to the glove 10 shown and described herein. In some embodiments, the glove 10 is a work glove. By way of example, the glove 10 may be configured for use when opening packages (e.g., boxes, bags, containers, etc.), handling items (e.g., moving them from one place to another), or other tasks.

As described herein, a longitudinal direction extends along a length the glove (e.g., between a wrist of a user to the fingertips of the user). Distal indicates something that is closer to the ends of the fingers of the glove 10, and proximal indicates something that is closer to the opening that receives a user's hand. A lateral direction extends along a width of the glove (e.g., between a side of the user's hand and the user's thumb). Inner indicates something that is closer to the thumb side (e.g., closer to a centerline of a body of a user wearing the gloves), and outer indicates something that is farther from the thumb side. A vertical direction extends along a thickness of the glove 10 (e.g., between the user's palm and a back of the user's hand). A top of the glove 10 corresponds to the back of a user's hand, and a bottom of the glove 10 corresponds to a palm of the user's hand. Interior refers to features within the glove 10, and exterior refers to features outside the glove 10.

The glove 10 includes a palm portion or main body, shown as main glove body 20, configured to contain a main portion of the user's hand containing the metacarpals. In some embodiments, a wrist portion or cuff is coupled to a first end of the main glove body 20 and configured to receive the wrist and/or forearm of the user. The main glove body 20 defines an aperture or opening, shown as inlet 32, through which a user can insert their hand into the glove 10. Coupled to a second end of the main glove body 20 opposite the cuff 30 are a series of fingers configured to receive the phalanges of the user's fingers. The fingers include a first finger or index glove finger, shown as index finger 40, a second finger or middle glove finger, shown as middle finger 42, a third finger or ring glove finger, shown as ring finger 44, and a fourth finger, little glove finger, or pinky glove finger, shown as pinky finger 46, configured to receive an index finger, a middle finger, a ring finger, and a pinky finger (i.e., a little finger) of the user, respectively. Each of these fingers of the glove 10 may extend longitudinally away from the main glove body 20. Each of these fingers of the glove 10 may be at least partially separated from one another (e.g., having a gap extending laterally between adjacent fingers) to facilitate individual movement of each finger. Coupled to a side of the main glove body 20 between the cuff 30 and the index finger 40 is a fifth finger or thumb glove finger, shown as thumb 50, configured to receive a thumb of the user. The thumb 50 extends laterally outward from the main glove body 20 and longitudinally along the length of the user's thumb. Together, the main glove body 20, the index finger 40, the middle finger 42, the ring finger 44, the pinky finger 46, and the thumb 50 define an inner volume configured to receive a hand and/or a wrist of the user.

The glove 10 may include a variety of different materials. By way of example, the glove may use fabric, leather, plastics, or other materials. The glove 10 may include flexible materials to facilitate movement of the user's hand. The glove 10 may include multiple different materials. By way of example, a finger of the glove 10 may utilize a first material layered onto a second material. In some embodiments, the materials are resistant to cutting or other penetration.

Figure 7:
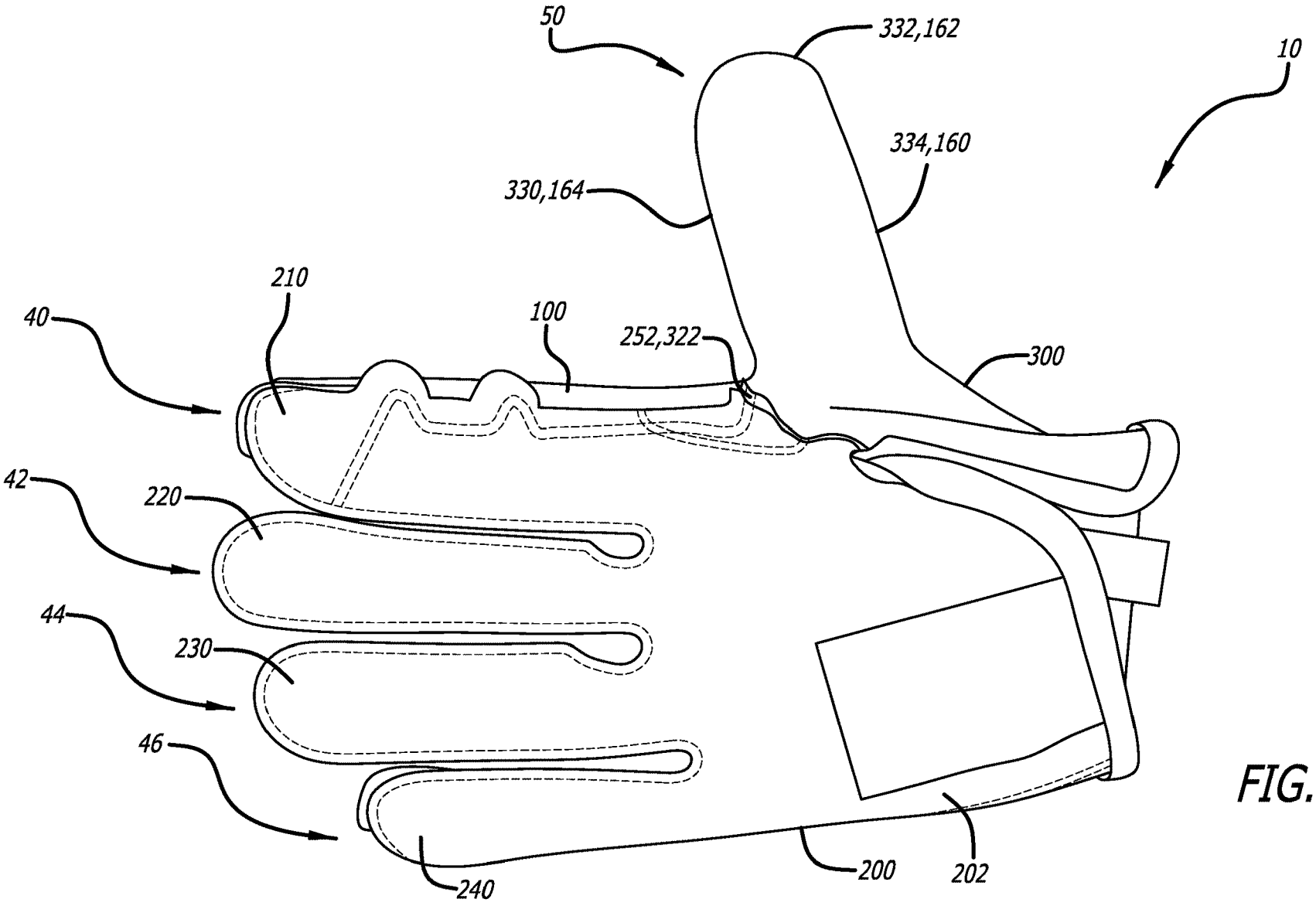
FIG. 7 is a top view of the glove of FIG. 1 in an everted configuration.
Figure 8:
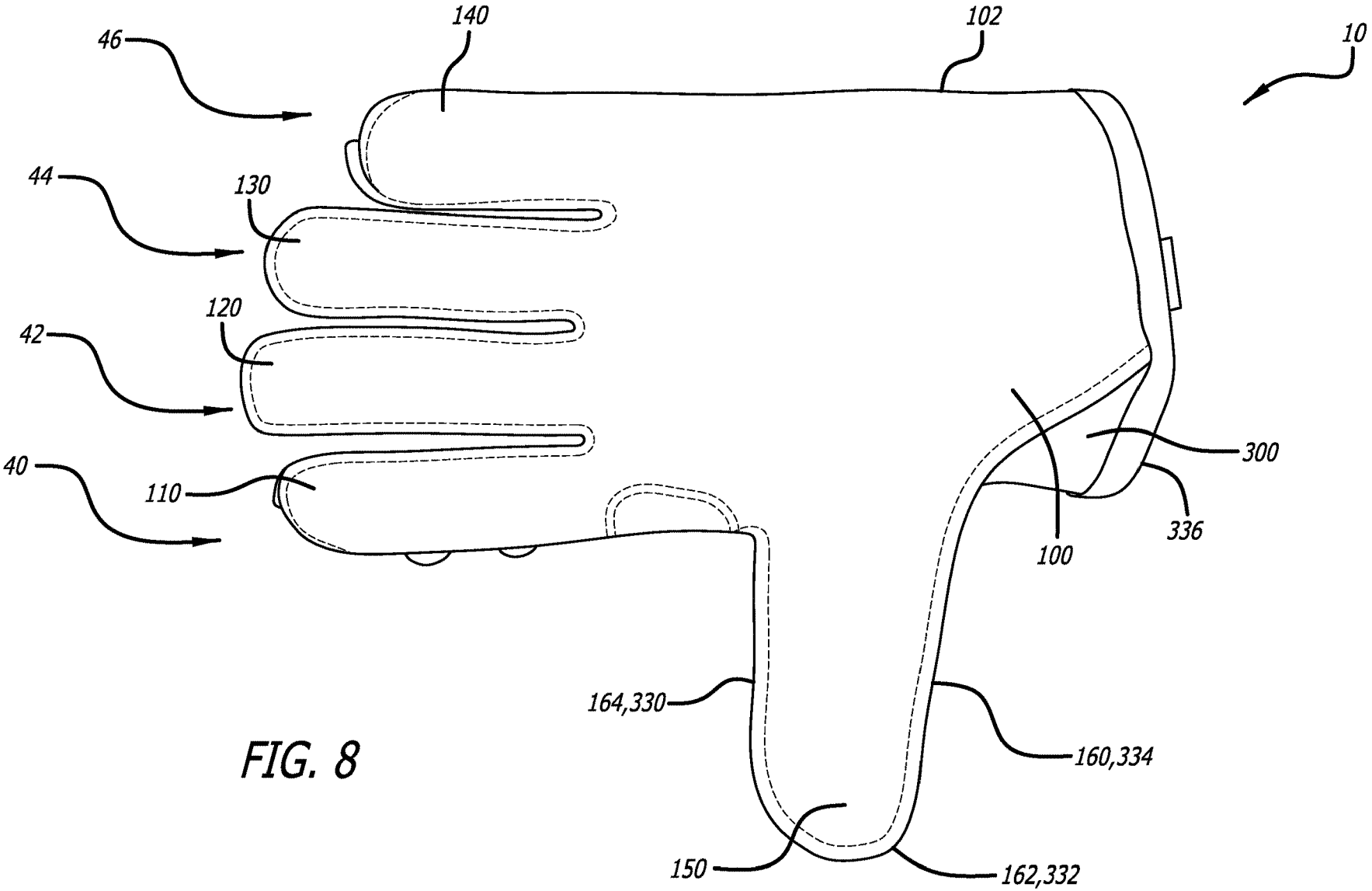
FIG. 8 is a bottom view of the glove of FIG. 1 in the everted configuration.
Figure 9:
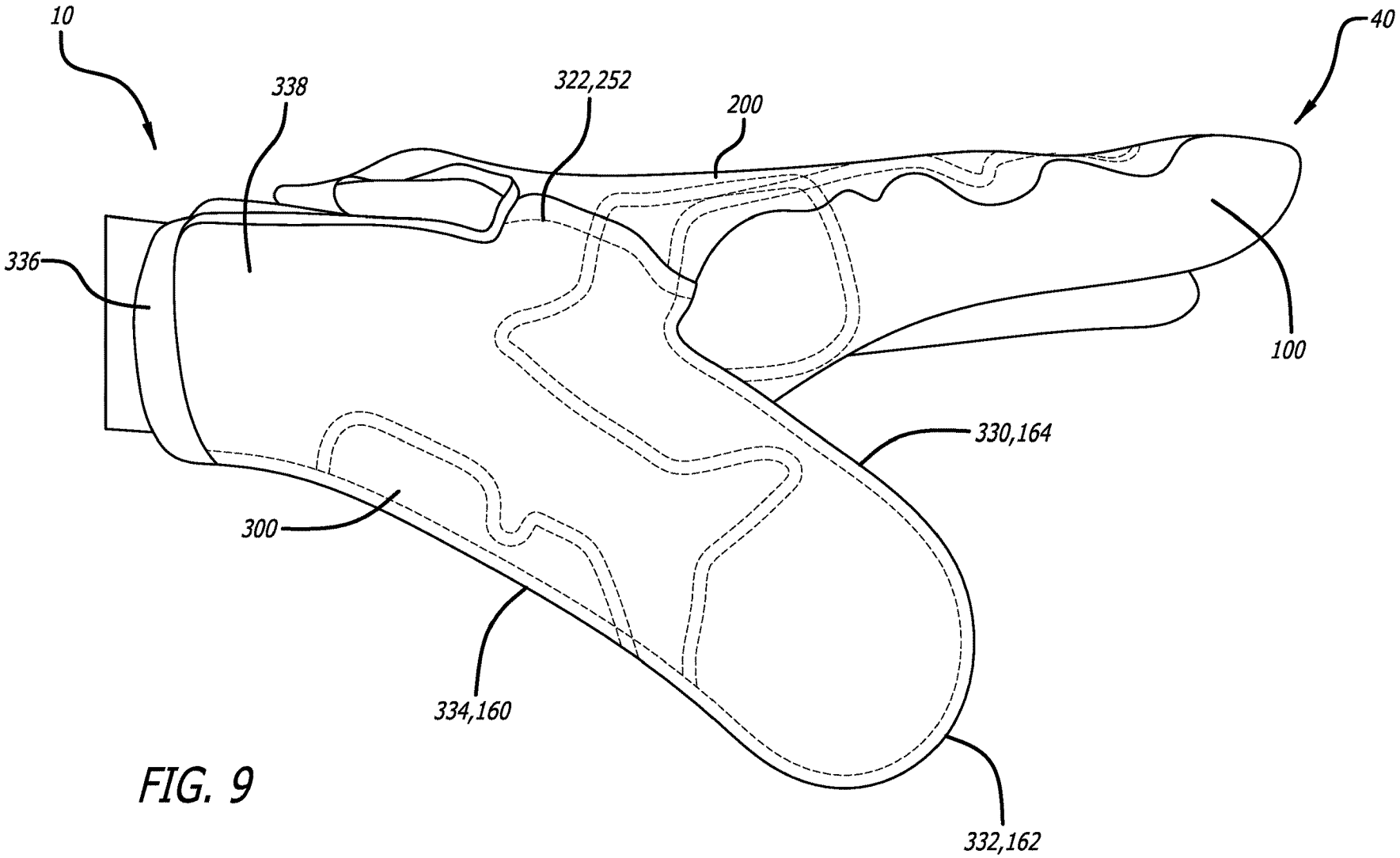
FIG. 9 is a right side view of the glove of FIG. 1 in the everted configuration.

Referring to FIGS. 1-19, the glove 10 is formed from a series of pieces, sheets, or panels that are coupled to one another. By way of example, the panels may be stitched (e.g., sewn, etc.) to one another along one or more seams. By way of another example, the panels may be bonded (e.g., using an adhesive, such as epoxy, etc.) to one another. In some embodiments, each panel begins as a flat sheet of material. The flat sheet is then formed (e.g., bent, rolled, folded, etc.) to the final shape of the glove 10. FIGS. 1-6 illustrate the glove 10 in a final, assembled configuration. FIGS. 7-9 illustrate the glove 10 in the final, assembled configuration, but the glove 10 is in an everted (i.e., inside out) configuration such that the interior surface of the glove 10 is shown on the exterior. FIGS. 10-18 illustrate the panels of the glove 10 in their flat pattern format, according to an exemplary embodiment. In these figures, solid lines indicate edges of the panels and/or cut lines (i.e., lines along which a piece of material is cut to form an edge of the panel). Dashed lines indicate the approximate center of a fold or bend or the edges of a component that is not visible. Such bends may have varying bend radii, depending upon their location within the glove 10. Although a specific set of panels is shown, in other embodiments, the glove 10 is formed using more or fewer panels.

Figure 3:
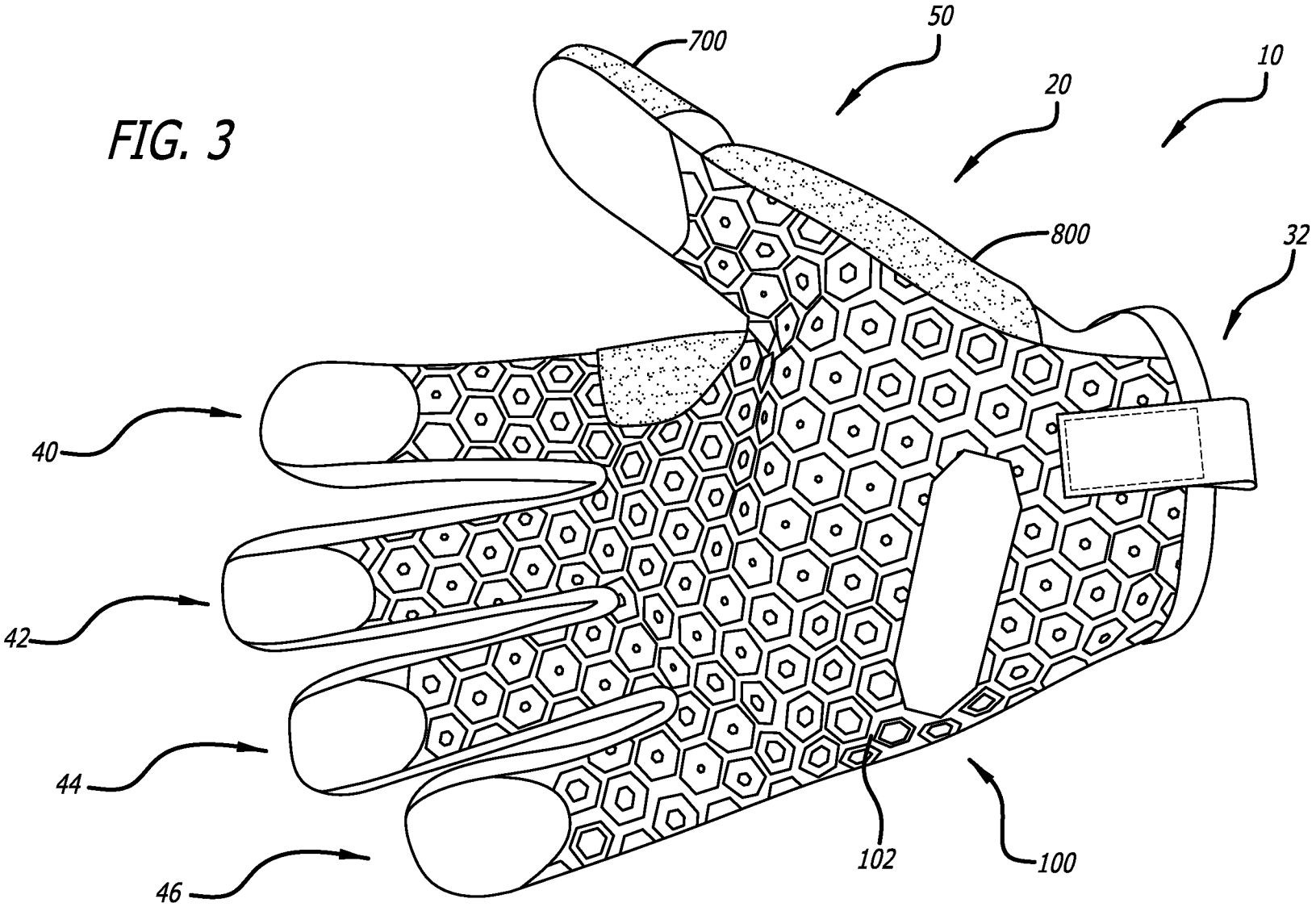
FIG. 3 is a bottom view of the glove of FIG. 1.
Figure 10:
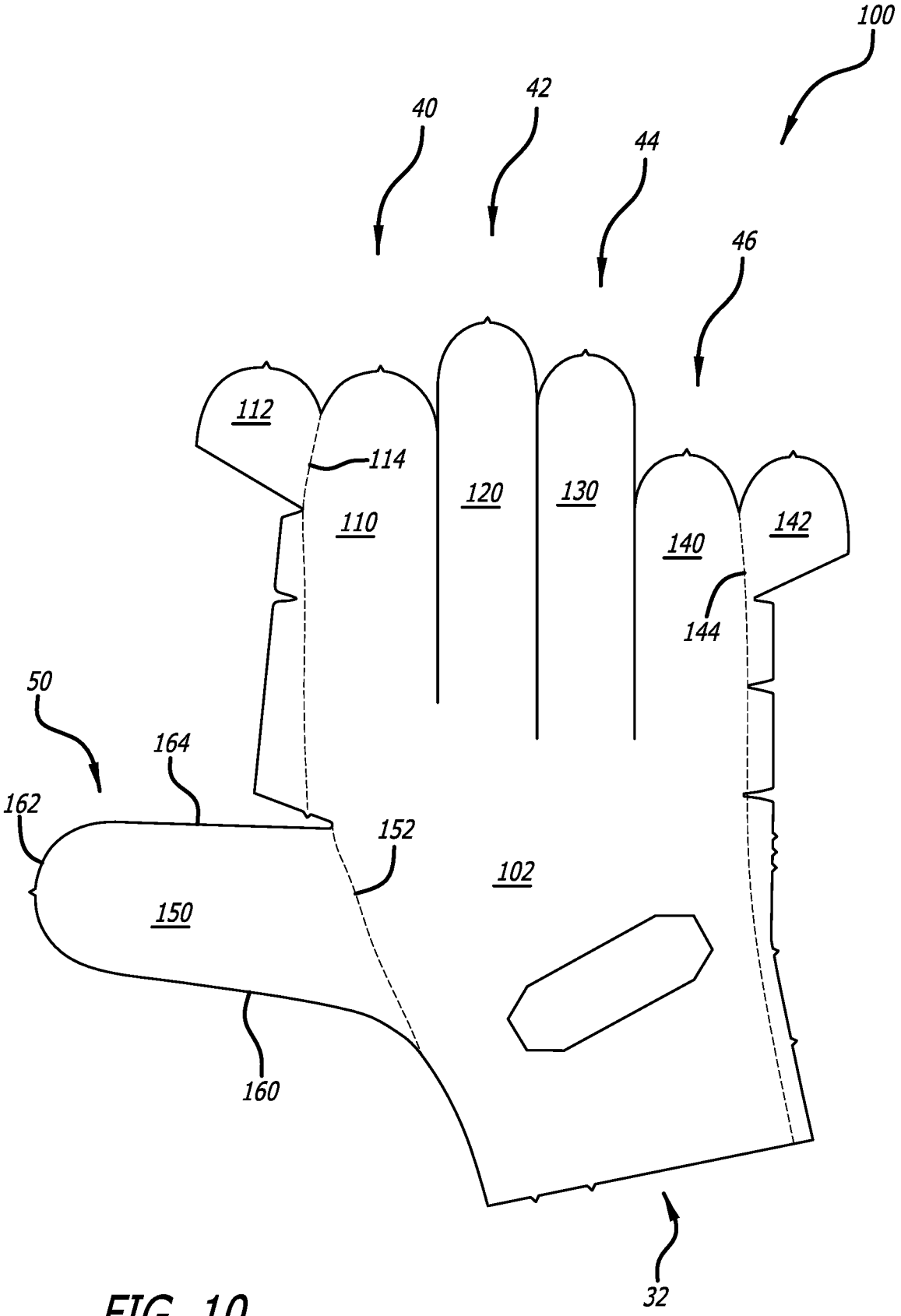
FIG. 10 is a bottom view of a flat pattern of a palm panel of the glove of FIG. 1.

Referring to FIGS. 3, 8, and 10, the glove 10 includes a first piece, sheet, or panel (e.g., a bottom panel), shown as palm panel 100. As shown, the palm panel 100 is formed from a single, continuous piece of material. In other embodiments, the palm panel 100 includes multiple pieces of material coupled to one another. The palm panel 100 defines bottom portions of the main glove body 20, the index finger 40, the middle finger 42, the ring finger 44, the pinky finger 46, and the thumb 50. The palm panel 100 also defines top portions of the index finger 40 and the pinky finger 46. Specifically, the palm panel 100 extends primarily along the bottom surfaces of a user's palm, index finger, middle finger, ring finger, pinky finger, and thumb. The palm panel 100 further extends along top surfaces of the user's index finger and pinky finger near the fingertips of such fingers.

The palm panel 100 includes a center portion, shown as main palm portion 102, that extends along a user's palm. The main palm portion 102 may form a bottom surface of the glove 10 when the glove 10 is complete (e.g., assembled). The palm panel 100 further includes a series of first finger portions including: an index finger portion 110 that extends along a bottom surface of a user's index finger;

a middle finger portion 120 that extends along a bottom surface of a user's middle finger; a ring finger portion 130 that extends along a bottom surface of a user's ring finger; and a pinky finger portion 140 that extends along a bottom surface of a user's pinky finger. Cuts separate each first finger portion from one another to permit independent movement of each finger of the glove 10. The index finger portion 110, the middle finger portion 120, the ring finger portion 130, and the pinky finger portion extend longitudinally away from the main palm portion 102. A second finger portion, shown as thumb portion 150, extends along a bottom surface of the user's thumb. The thumb portion 150 extends laterally outward from the main palm portion 102. When the glove 10 is assembled, the thumb portion 150 is bent relative to the main palm portion 102 about a bend line 152, which extends longitudinally between the thumb portion 150 and the main palm portion 102.

The palm panel 100 further includes a fingertip portion, shown as index tip portion 112, that extends laterally away from the index finger portion 110 in the thumb direction in the flat pattern. A longitudinal bend line, shown as fingertip bend line 114, extends between the index finger portion 110 and the index tip portion 112. The index tip portion 112 is bent relative to the index finger portion 110 about the fingertip bend line 114 such that the index tip portion 112 extends along a top surface of a user's index finger near the fingertip when the glove 10 is in a completed state. A seam extends along a perimeter of the index tip portion 112 and the index finger portion 110 such that the index tip portion 112 and the index finger portion 110 contain the fingertip of the user's index finger therebetween.

The palm panel 100 further includes a fingertip portion, shown as pinky tip portion 142, that extends laterally away from the pinky finger portion 140 away from the thumb in the flat pattern. A longitudinal bend line, shown as fingertip bend line 144, extends between the pinky finger portion 140 and the pinky tip portion 142. The pinky tip portion 142 is bent relative to the pinky finger portion 140 about the fingertip bend line 144 such that the pinky tip portion 142 extends along a top surface of a user's pinky finger near the fingertip when the glove 10 is in a completed state. A seam extends along a perimeter of the pinky tip portion 142 and the pinky finger portion 140 such that the pinky tip portion 142 and the pinky finger portion 140 contain the fingertip of the user's pinky finger therebetween.

Referring to FIG. 10, proceeding along a perimeter of the palm panel 100, the palm panel 100 has a series of edges. This includes a first longitudinal edge or lateral edge, shown as seam edge 160, extending longitudinally and laterally away from the edge of the inlet 32. A curved, circumferential edge, shown as seam edge 162, extends around the fingertip of the thumb 50. A second longitudinal or lateral edge, shown as seam edge 164, extends laterally from the seam edge 162 to the main palm portion 102.

In some embodiments, an exterior surface of the palm panel 100 is configured to maximize a coefficient of friction between the glove 10 and objects gripped by the glove 10 (e.g., maximize the grip of the glove 10). In some embodiments, the palm panel 100 is coated in a high friction material, such as silicone. The palm panel 100 may also be textured to increase friction. As shown in FIG. 3, the palm panel 100 is formed with a tessellated hexagon pattern.

Figure 2:
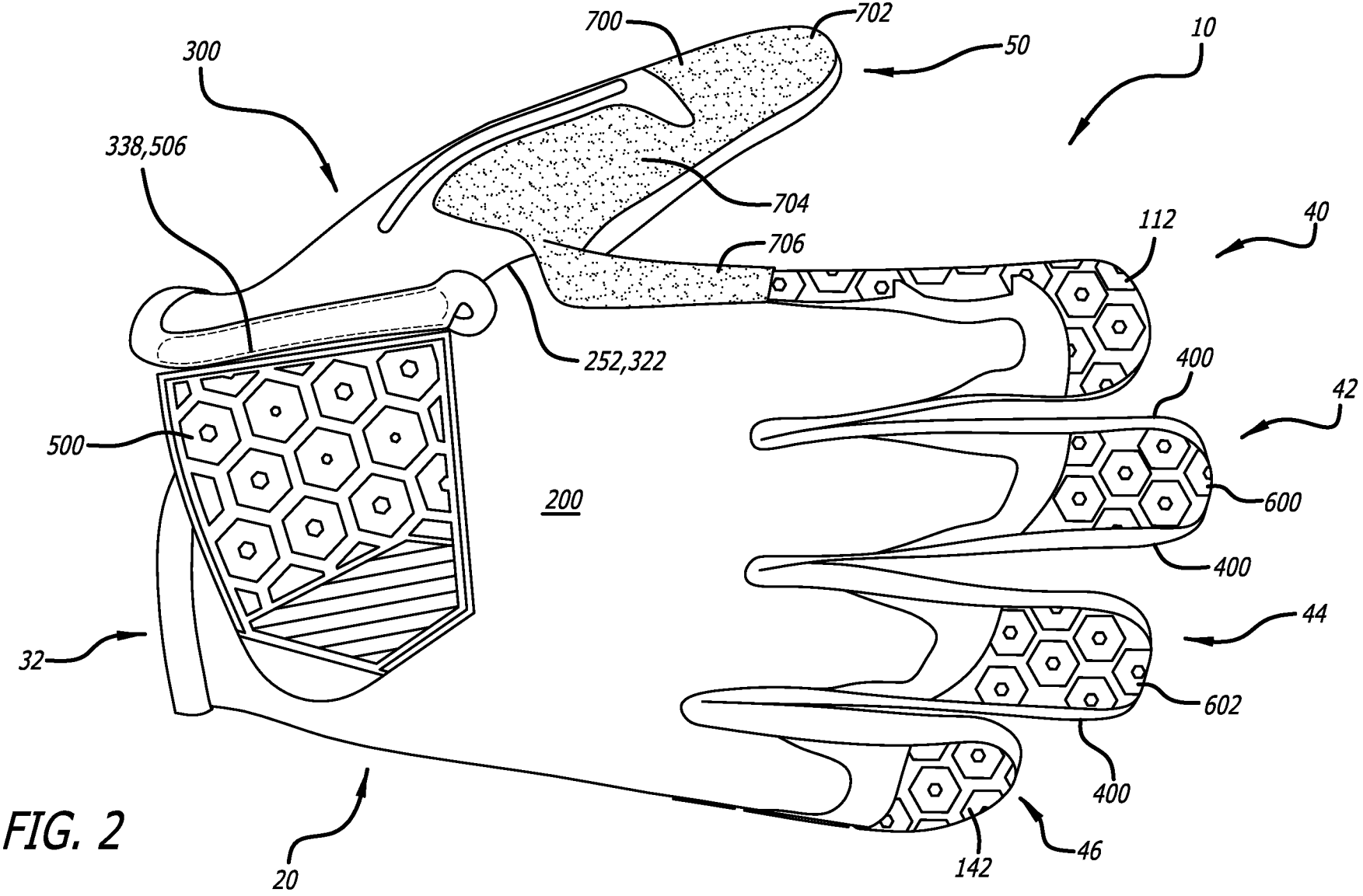
FIG. 2 is a top view of the glove of FIG. 1.
Figure 11:
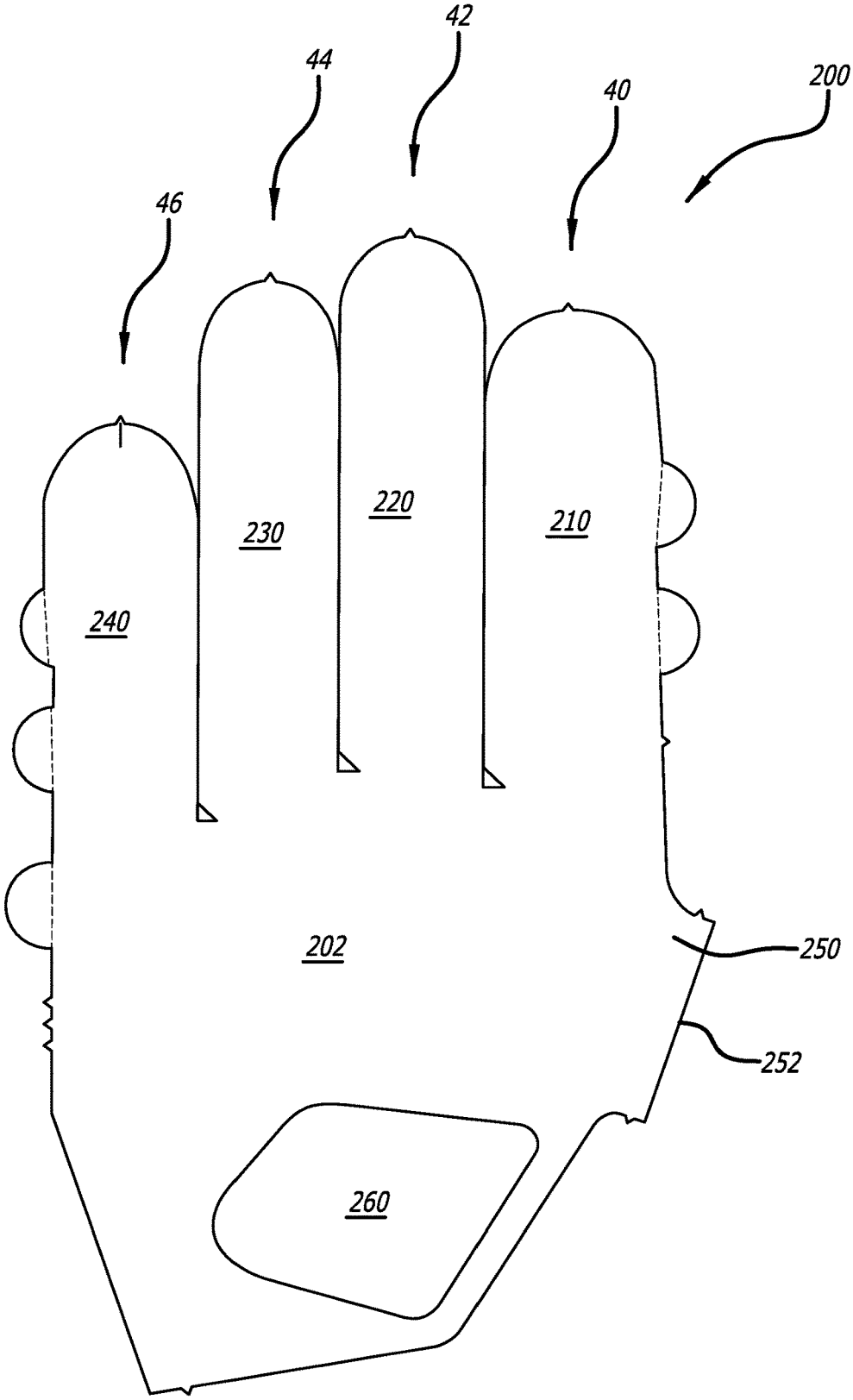
FIG. 11 is a top view of a flat pattern of a back panel of the glove of FIG. 1.

Referring to FIGS. 1, 2, and 11, the glove 10 includes a second piece, sheet, or panel, (e.g., a top panel) shown as back panel 200. As shown, the back panel 200 is formed from a single, continuous piece of material. In other embodiments, the back panel 200 includes multiple pieces of material coupled to one another. The back panel 200 defines portions of the main glove body 20, the index finger 40, the middle finger 42, the ring finger 44, and the pinky finger 46. Specifically, the back panel 200 extends primarily along top surfaces of the back of a user's hand and a user's, index finger, middle finger, ring finger, and pinky finger.

The back panel 200 includes a center portion, main portion, knuckle portion, or hand back portion, shown as main back portion 202, that extends along the back of a user's hand. Specifically, as shown, the main back portion 202 extends across a user's knuckles and metacarpals of a user's index finger, middle finger, ring finger, and pinky finger. The main back portion 202 may form a top surface of the glove 10 when the glove 10 is complete. Coupled to and extending longitudinally away from the main back portion 202 are a series of finger portions, shown as index finger portion 210, middle finger portion 220, ring finger portion 230, and pinky finger portion 240. The index finger portion 210, the middle finger portion 220, the ring finger portion 230, and the pinky finger portion 240 are configured to extend along top surfaces of a user's index finger, middle finger, ring finger, and pinky finger, respectively. Cuts separate each finger portion from one another to permit independent movement of each finger of the glove 10.

A flange, panel, or protrusion, shown as thumb coupling flange 250, is coupled to and extends outward from the main back portion 202. Specifically, the thumb coupling flange 250 extends laterally inward in the flat pattern. The thumb coupling flange 250 has a longitudinally-extending edge, shown as seam edge 252. The thumb coupling flange 250 is configured to couple the main back portion 202 to the thumb panel 300.

The back panel 200 is coupled to a fastener, shown as fastener pad 260. The fastener pad 260 is configured to selectively couple to the closure flap 500 to facilitate tightening and/or loosening the glove 10. In some embodiments, the fastener pad 260 is the hook portion or the loop portion of a hook-and-loop fastener system (e.g., Velcro).

Referring to FIGS. 1, 6, 7, 9, and 12, the glove 10 includes a third piece, sheet, or panel, (e.g., a top panel) shown as thumb panel 300. As shown, the thumb panel 300 is formed from a single, continuous piece of material. The thumb panel 300 defines a portion of the thumb 50. Specifically, the thumb panel 300 extends primarily along a top surface of the user's thumb.

Figure 6:
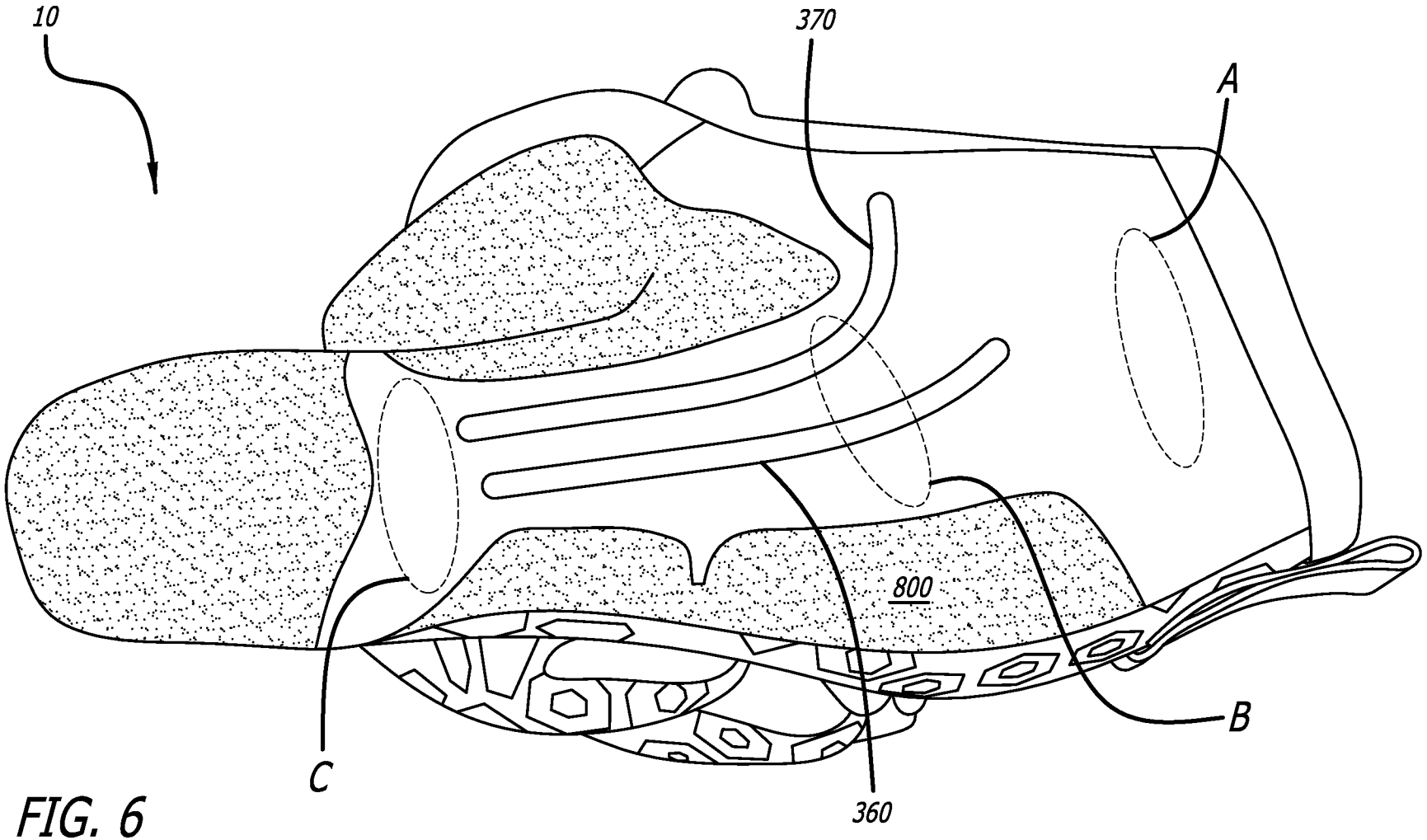
FIG. 6 is a top view of a thumb of the glove of FIG. 1.
Figure 12:
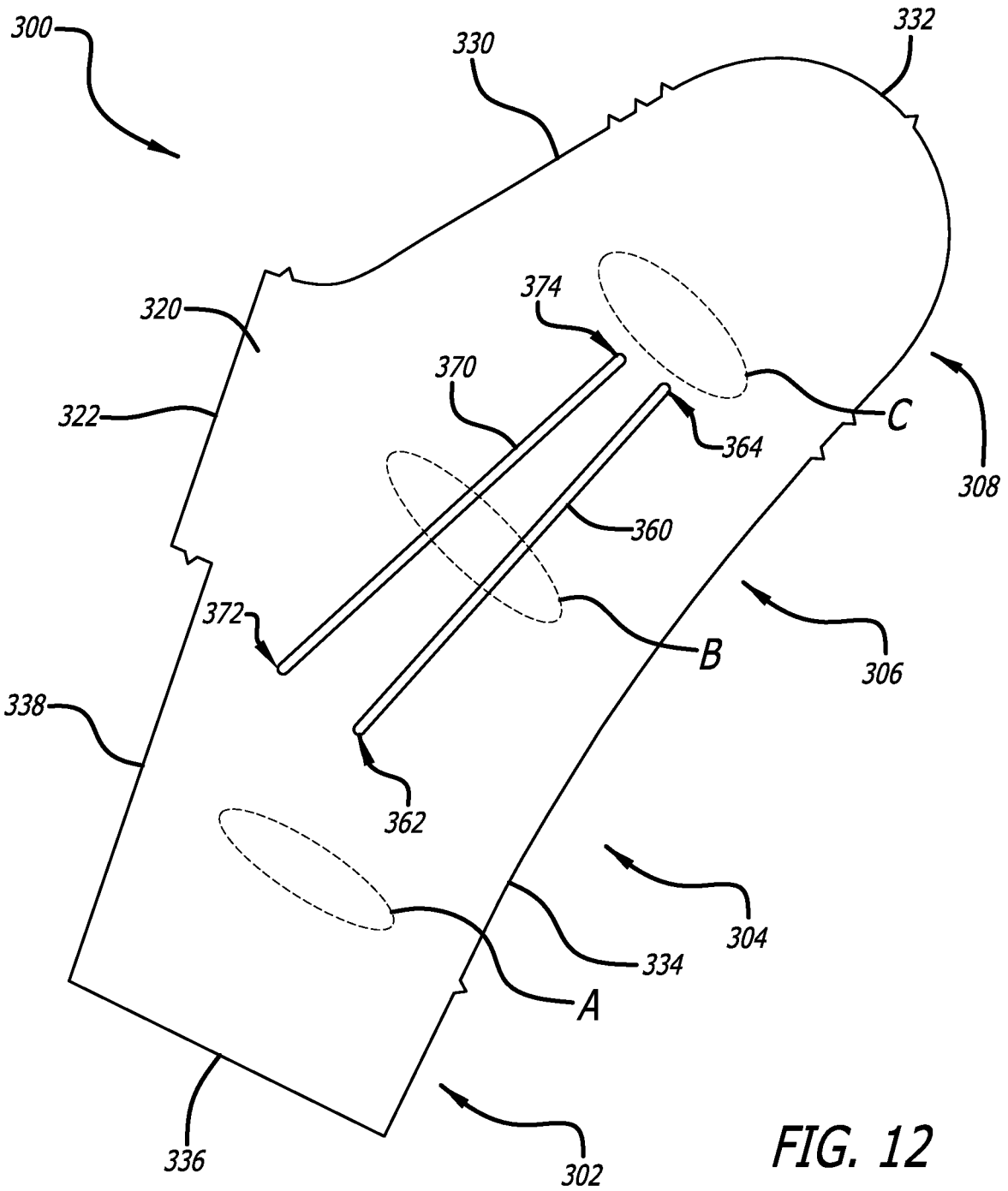
FIG. 12 is a top view of a flat pattern of a thumb panel of the glove of FIG. 1.

In FIGS. 6 and 12, the general locations of the user's thumb joints or knuckles relative to the thumb panel 300 are shown. A first joint, shown as base joint A, is positioned between and connects the user's carpals and the user's thumb metacarpal. A second joint, shown as middle joint B, is positioned between and connects the user's thumb metacarpal and the user's proximal thumb phalanx. A third joint, shown as distal joint C, is positioned between and connects the user's distal thumb phalanx and the user's proximal thumb phalanx.

A first portion of the thumb panel 300, shown as wrist portion 302, extends proximally of the base joint A, all of the way to the edge of the inlet 32 (e.g., as shown in FIG. 6). The wrist portion 302 covers part of the user's wrist. A second portion of the thumb panel 300, shown as metacarpal portion 304, extends between the base joint A and the middle joint B. The metacarpal portion 304 covers a portion of a user's thumb associated with the thumb metacarpal. A third portion of the thumb panel 300, shown as proximal phalanx portion 306, extends between the middle joint B and the distal joint C. The proximal phalanx portion 306 covers part of a user's hand associated with the proximal thumb phalanx. A fourth portion of the thumb panel 300, shown as fingertip portion 308, extends distally of the distal joint C, all of the way to the fingertip of the thumb 50 (e.g., as shown in FIG. 7). The fingertip portion 308 covers part of a user's distal thumb phalanx. The wrist portion 302, the metacarpal portion 304, the proximal phalanx portion 306, and the fingertip portion 308 may all be formed from a single, continuous piece of material.

Referring to FIG. 12, a flange, panel, or protrusion, shown as back coupling flange 320, is coupled to and extends outward from the metacarpal portion 304 and the proximal phalanx portion 306. Specifically, the back coupling flange 320 extends laterally outward in the flat pattern. The back coupling flange 320 has a longitudinally-extending edge, shown as seam edge 322. The back coupling flange 320 is configured to couple the back panel 200 to the thumb panel 300.

Proceeding clockwise from the seam edge 322 around the perimeter of the thumb panel 300, the thumb panel 300 has a series of edges. This includes a first longitudinal edge, shown as seam edge 330, extending longitudinally in a distal direction from the back coupling flange 320. A curved, circumferential edge, shown as seam edge 332, extends around the fingertip of the thumb 50. A second longitudinal edge, shown as seam edge 334, extends longitudinally in a proximal direction from the seam edge 332. A lateral edge, shown as inlet edge 336, extends laterally across the thumb panel 300 from the seam edge 334. A third longitudinal edge, shown as seam edge 338, extends longitudinally between the inlet edge 336 and the back coupling flange 320.

Figure 13:
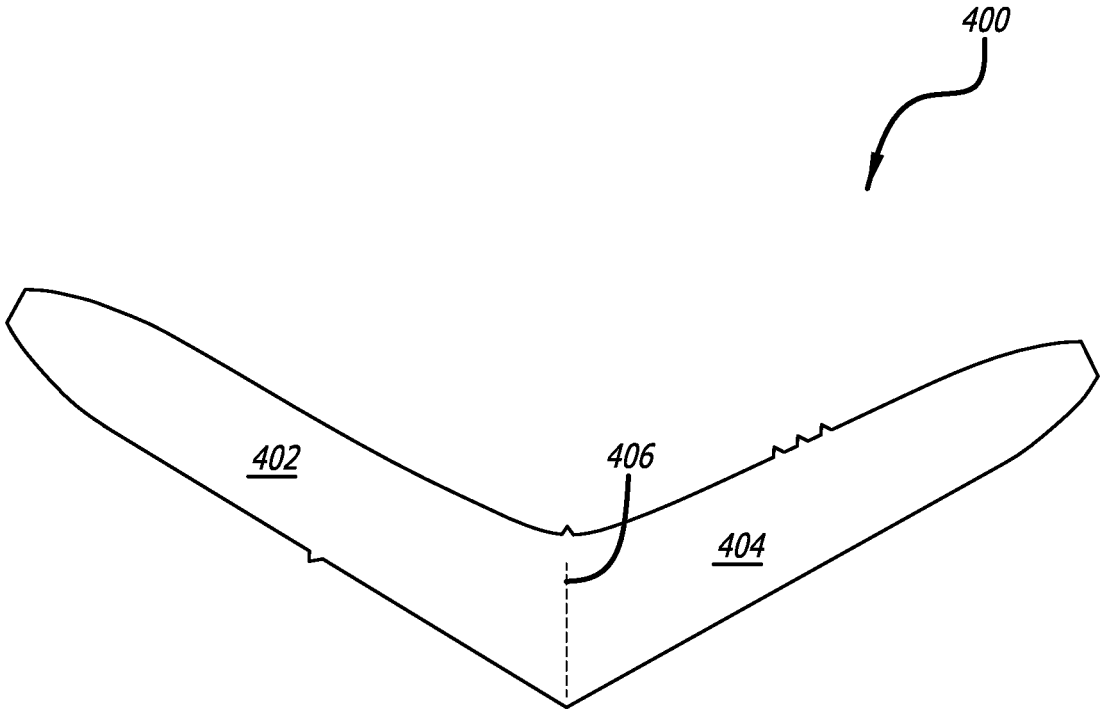
FIG. 13 is a top view of a flat pattern of an inner finger panel of the glove of FIG. 1.

Referring to FIGS. 2 and 13, the glove 10 further includes a series of pieces, sheets, or panels, shown as inner finger panels 400. As shown, each inner finger panel 400 is formed from a single, continuous piece of material. In other embodiments, the inner finger panels 400 include multiple pieces of material coupled to one another. Each inner finger panel 400 extends along a right side of one finger and a left side of the adjacent finger. As shown, a first inner finger panel 400 defines portions of the index finger 40 and the middle finger 42. A second inner finger panel 400 defines portions of the middle finger 42 and the ring finger 44. A third inner finger panel 400 defines portions of the ring finger 44 and the pinky finger 46. Accordingly, the inner finger panels 400 extend along (a) a right side of the user's index finger, (b) right and left sides of the user's middle finger and ring finger, and (c) a left side of the user's pinky finger.

Each inner finger panel includes a first finger portion, shown as left finger portion 402, continuous with a second finger portion, shown as right finger portion 404. A bend line 406 extends between the two finger portions. After the glove 10 is complete, both the left finger portion 402 and the right finger portion 404 extend longitudinally and in a vertical plane.

Figure 14:
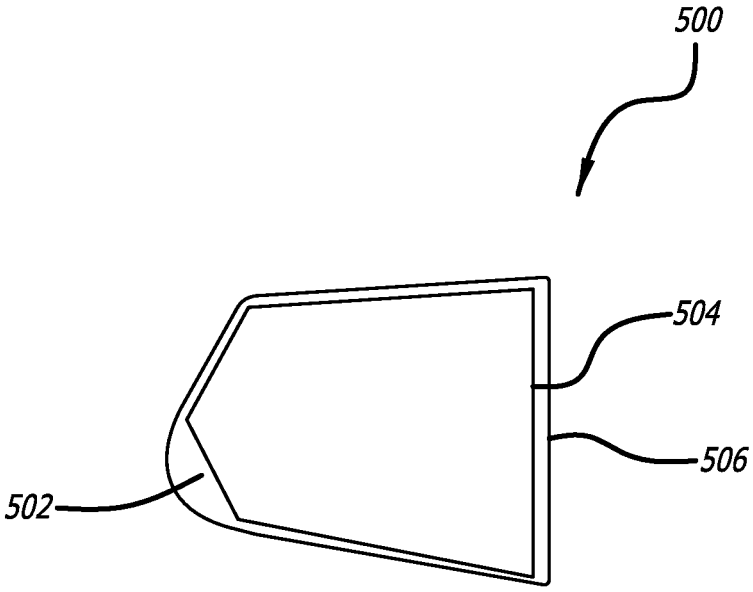
FIG. 14 is a top view of a flat pattern of a closure flap of the glove of FIG. 1.

Referring to FIGS. 2 and 14, the glove further includes a piece, sheet, or panel, shown as closure flap 500. The closure flap 500 is made from a single piece of material. In some embodiments, the closure flap 500 is made from rubber or plastic. The closure flap 500 is configured to extend across the back of a user's hand. A fastener, shown as fastener pad 504, extends along a bottom side of the closure flap 500. The fastener pad 504 is selectively coupled to the fastener pad surface 502 to facilitate tightening and/or loosening of the glove 10. In some embodiments, the fastener pad 260 and the fastener pad 504 are opposite parts of a hook-and-loop fastener system (e.g., one is a hook portion and the other is the loop portion). In such embodiments, the closure flap 500 may be decoupled from the fastener pad 260 by applying a threshold force. The closure flap 500 defines a longitudinal edge, shown as seam edge 506, that is coupled to the thumb panel 300.

Figure 15:
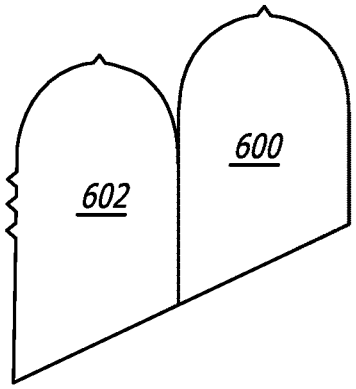
FIG. 15 is a bottom view of a flat pattern of fingertip panels of the glove of FIG. 1.
Figure 16:
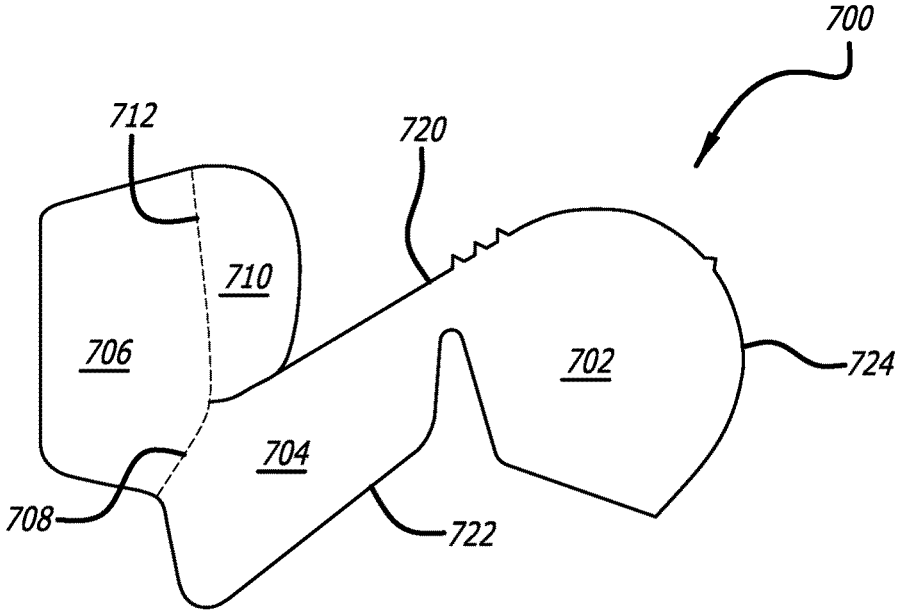
FIG. 16 is a bottom view of a flat pattern of a crotch reinforcement panel of the glove of FIG. 1.

Referring to FIGS. 2 and 15, the glove 10 further includes a pair of pieces, sheets, or panels (e.g., fingertip panels), shown as middle tip portion 600 and ring tip portion 602. The middle tip portion 600 defines a top portion of the middle finger 42 near the fingertip. The middle tip portion 600 extends along a top surface of a user's middle finger. The ring tip portion 602 defines a top portion of the ring finger 44 near the fingertip. The ring tip portion 602 extends along a top surface of a user's ring finger. The outer, exposed surface of the middle tip portion 600 and the ring tip portion 602 may be configured to maximize a coefficient of friction between the fingertips of the glove and other objects (e.g., similar to the configuration of the palm panel 100). In some embodiments, the palm panel 100, the middle tip portion 600, and the ring tip portion 602 are all made from the same material. Configuring the middle tip portion 600 and the ring tip portion 602 with a high coefficient of friction may prevent the glove 10 from slipping when the fingertips of the glove 10 are gripped (e.g., by a user's hand). This may facilitate removal of the glove 10 by the user without slipping.

Referring to FIGS. 1, 2, 6, and 16, the glove 10 further includes a sheet, piece, or panel, shown as crotch reinforcement panel 700. The crotch reinforcement panel 700 is configured to increase the thickness of the glove 10 in locations (e.g., the crotch of the user's thumb) that commonly contact items gripped by a user (e.g., tools, such as box cutters, the edges of boxes, etc.). This increases the amount of wear that can be sustained in these high-use areas, thereby increasing the working life of the glove 10. Specifically, the crotch reinforcement panel 700 extends along the thumb 50 and the main glove body 20 such that the crotch reinforcement panel 700 engages items that are gripped in the crotch of the user's thumb, between the thumb and the palm. In some embodiments, the crotch reinforcement panel 700 is configured to have a lesser coefficient of friction with other objects than the palm panel 100, the middle tip portion 600, and/or the ring tip portion 602 (e.g., is configured to slip when engaging other objects). This may facilitate a user adjusting their grip on an object (e.g., moving their hand to a different location along the length of a tool).

As shown, the crotch reinforcement panel 700 is formed from a single, continuous piece of material. In other embodiments, the crotch reinforcement panel 700 includes multiple pieces of material coupled to one another. The crotch reinforcement panel 700 defines portions of the main glove body 20 and the thumb 50. Specifically, the crotch reinforcement panel 700 extends along bottom and side surfaces of a user's palm and a top surface of a user's thumb.

The crotch reinforcement panel 700 includes a first portion (e.g., a fingertip portion), shown as thumb tip portion 702. The thumb tip portion 702 extends along a top of the thumb 50 near the fingertip. The thumb tip portion 702 covers a portion of the user's thumb associated with the distal thumb phalanx. A second portion, shown as middle thumb portion 704, extends longitudinally from the thumb tip portion 702 to the crotch of the user's thumb (e.g., near the proximal phalanx portion 306 of the thumb panel 300). A third portion, shown as side palm portion 706, extends longitudinally forward from the middle thumb portion 704 along the thumb side of the main glove body 20. The middle thumb portion 704 and the side palm portion 706 are bent relative to one another about a vertical bend line, shown as bend line 708. The bend line 708 extends along the crotch of thumb 50 to facilitate movement of the user's thumb relative to the user's palm. A fourth portion, shown as bottom palm portion 710, extends laterally from the side palm portion 706, along the bottom side of the main glove body 20. The bottom palm portion 710 is bent relative to the side palm portion 706 about a longitudinal bend line 712.

The middle thumb portion 704 has two longitudinal edges: a seam edge 720 continuous with a curved outer perimeter of the thumb tip portion 702 and an exposed edge 722 positioned opposite the seam edge 720. The seam edge 720 and the exposed edge 722 may be substantially parallel to one another. The thumb tip portion 702 has a circumferential edge, shown as seam edge 724, that extends along the curved outer perimeter of the thumb tip portion 702.

Figure 4:
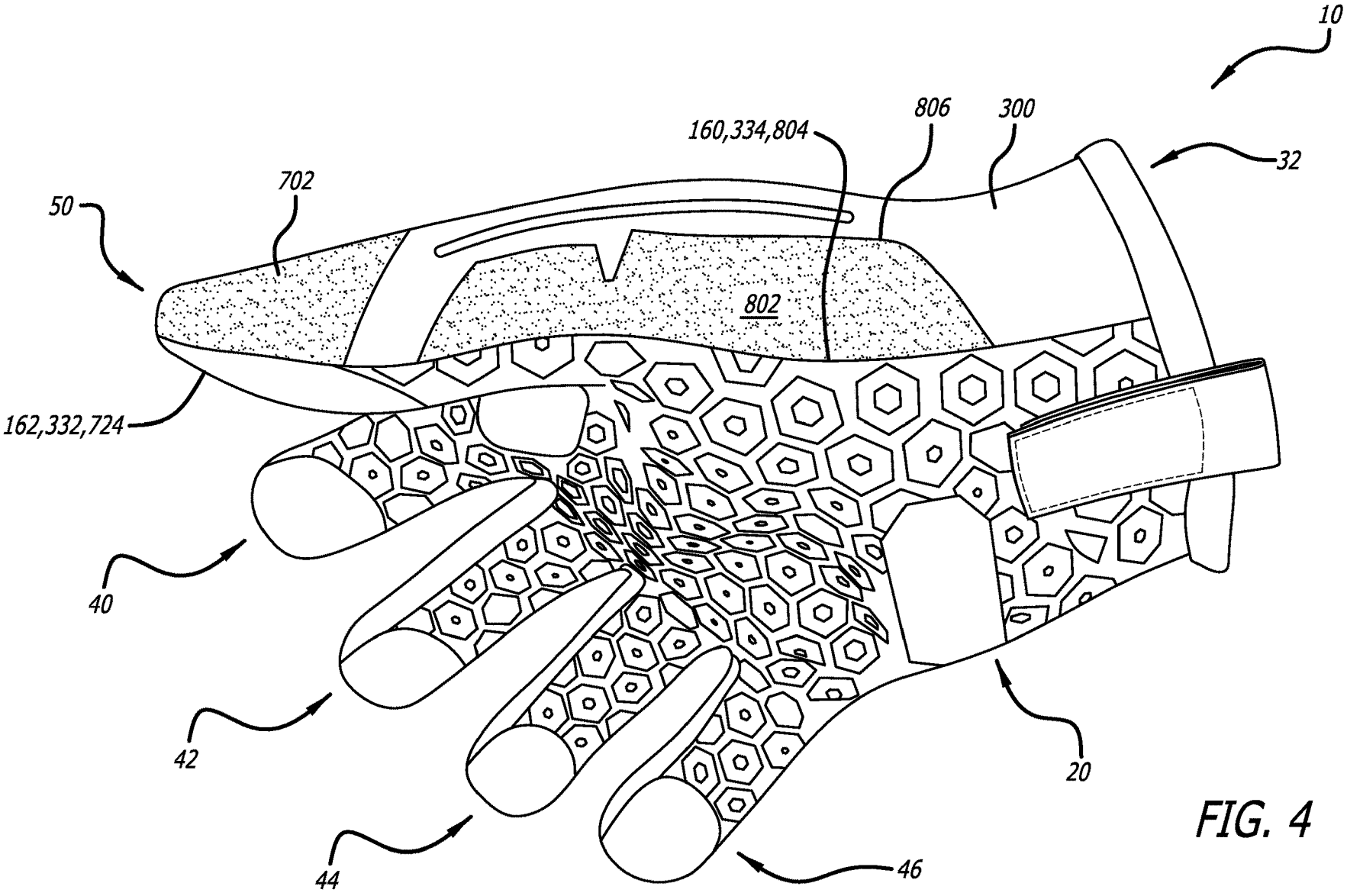
FIG. 4 is a bottom left perspective view of the glove of FIG. 1.
Figure 5:
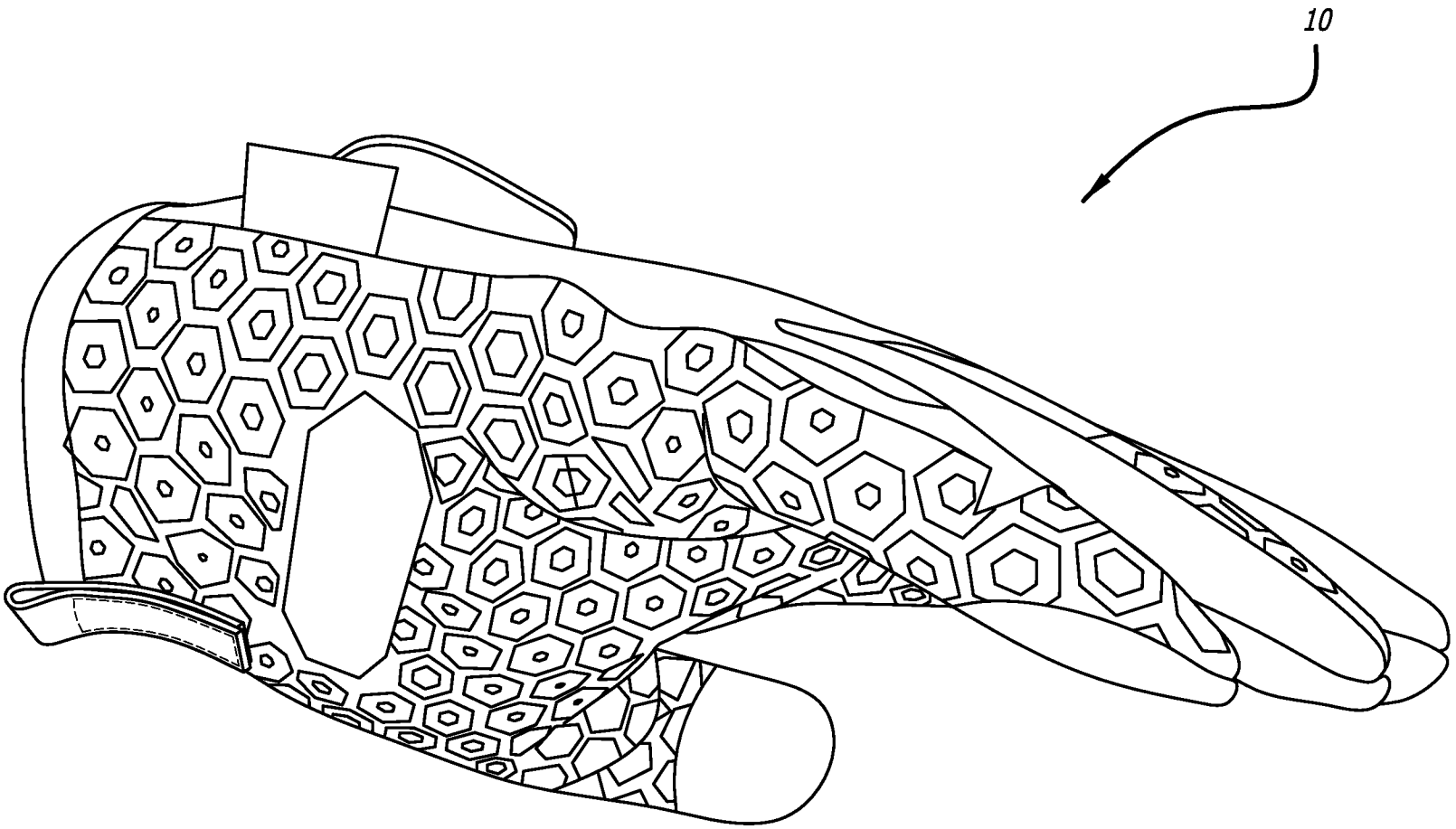
FIG. 5 is a right side view of the glove of FIG. 1.
Figure 17:
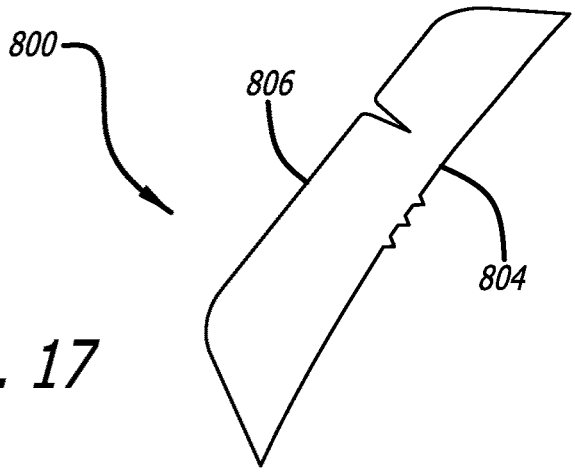
FIG. 17 is a bottom view of a flat pattern of a rest reinforcement panel of the glove of FIG. 1.

Referring to FIGS. 4 and 17, the glove 10 further includes a sheet, piece, or panel, shown as rest reinforcement panel 800. The rest reinforcement panel 800 is configured to increase the thickness of the glove 10 in a location where the thumb of the user rests on a support surface (e.g., a table, a box, their leg, etc.). This portion of the glove 10 may frequently come into contact with other surfaces, and may be slid across such surfaces, causing wear on the glove 10. By increasing the thickness of the glove 10 in these areas, the working life of the glove 10 may be increased.

As shown, the rest reinforcement panel 800 is formed from a single, continuous piece of material. In other embodiments, the rest reinforcement panel 800 includes multiple pieces of material coupled to one another. The rest reinforcement panel 800 extends longitudinally along a side of the thumb 50. Specifically, the rest reinforcement panel 800 extends longitudinally across the metacarpal portion 304 and the proximal phalanx portion 306 of the thumb panel 300 (e.g., from the base joint A to the distal joint C). The rest reinforcement panel 800 has two longitudinal edges: a seam edge 804 and an exposed edge 806 positioned opposite the seam edge 804. The seam edge 804 and the exposed edge 806 may be substantially parallel to one another.

In order to assemble the glove 10, seams are formed between the various panels, fixedly coupling the panels to one another. Referring to FIGS. 2, 3, 10, and 11, the palm panel 100 is coupled to the back panel 200 by a pair of seams. A first longitudinal seam extends between (a) the main palm portion 102 and the index finger portion 110 and (b) the main back portion 202 and the index finger portion 210. A second longitudinal seam extends between (a) the main palm portion 102 and the pinky finger portion 140 and (b) the main back portion 202 and the pinky finger portion 240.

Referring to FIGS. 2, 10, 11, and 13, two seams couple a first one of the inner finger panels 400 to the palm panel 100 and the back panel 200. A first longitudinal seam extends (a) between the index finger portion 110 and the left finger portion 402 and (b) between the middle finger portion 120 and the right finger portion 404. A second longitudinal seam extends (a) between the index finger portion 210 and the left finger portion 402 and (b) between the middle finger portion 220 and the right finger portion 404.

Two seams couple a second one of the inner finger panels 400 to the palm panel 100 and the back panel 200. A first longitudinal seam extends (a) between the middle finger portion 120 and the left finger portion 402 and (b) between the ring finger portion 130 and the right finger portion 404. A second longitudinal seam extends (a) between the middle finger portion 220 and the left finger portion 402 and (b) between the ring finger portion 230 and the right finger portion 404.

Two seams couple a third one of the inner finger panels 400 to the palm panel 100 and the back panel 200. A first longitudinal seam extends (a) between the ring finger portion 130 and the left finger portion 402 and (b) between the pinky finger portion 140 and the right finger portion 404. A second longitudinal seam extends (a) between the ring finger portion 230 and the left finger portion 402 and (b) between the pinky finger portion 240 and the right finger portion 404.

Referring to FIGS. 2 and 15, the middle tip portion 600 is placed atop the middle finger portion 220 of the back panel 200 and held in place with lateral and longitudinal seams. The ring tip portion 602 is placed atop the ring finger portion 230 of the back panel 200 and held in place with lateral and longitudinal seams.

Figure 18:
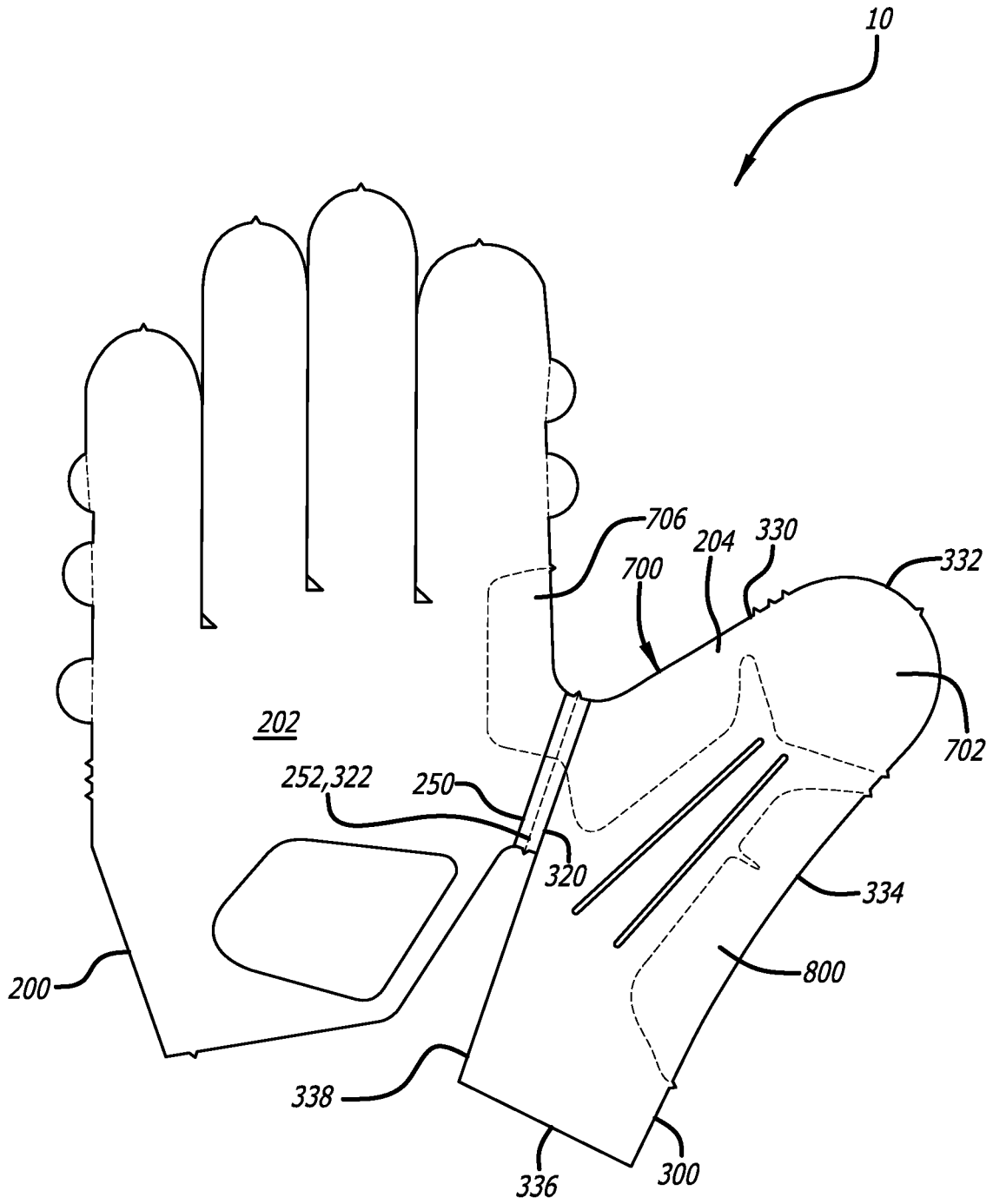
FIG. 18 is a top view of a flat pattern of the back panel of FIG. 11 assembled with the thumb panel of FIG. 12.

Referring to FIG. 18, the thumb panel 300 is coupled to the back panel 200 by a longitudinal seam. Specifically, the thumb coupling flange 250 and the back coupling flange 320 are placed against one another. A seam is formed between the seam edge 252 and the seam edge 322.

Referring to FIGS. 7-10 and 12, the thumb panel 300 is coupled to the palm panel 100 by a continuous seam. Generally, the thumb panel 300 is aligned with the thumb portion 150. The seam is formed between (a) the seam edge 334 and the seam edge 160, (b) the seam edge 332 and the seam edge 162, and (c) the seam edge 330 and the seam edge 164. This seam directly couples the thumb panel 300 to the main palm portion 102 and the thumb portion 150.

Referring to FIGS. 1-4, 10, 12, and 16, the crotch reinforcement panel 700 is incorporated into the seam that couples the thumb panel 300 to the palm panel 100. Accordingly, this seam couples the crotch reinforcement panel 700 to the thumb panel 300. Specifically, the seam edge 720 of the crotch reinforcement panel 700 is inserted between the seam edge 330 and the seam edge 164. The seam edge 724 of the crotch reinforcement panel 700 is inserted between the seam edge 332 and the seam edge 162. Additional seams further couple the crotch reinforcement panel 700 to the outer surfaces of the palm panel 100, the back panel 200, and the thumb panel 300.

As shown in FIG. 1, the crotch reinforcement panel 700 covers a portion of the seam between the seam edge 322 and the seam edge 252, protecting the seam from being directly contacted by a gripped object. Seams may generally be weaker than a continuous piece of material. Accordingly, the seams may act as a potential failure point. By covering the seam, the crotch reinforcement panel 700 reduces the probability that a failure will occur at the seam.

Referring to FIGS. 4, 10, 12, and 17, the rest reinforcement panel 800 is incorporated into the seam that couples the thumb panel 300 to the palm panel 100. Accordingly, this seam couples the rest reinforcement panel 800 to the thumb panel 300. Specifically, the seam edge 804 of the rest reinforcement panel 800 is inserted between the seam edge 335 and the seam edge 160. Additional seams further couple the rest reinforcement panel 800 to the outer surface of the thumb panel 300.

Referring to FIGS. 2, 12, and 14, a longitudinal seam couples the closure flap 500 to the thumb panel 300. Specifically, the seam extends along the seam edge 338 and the seam edge 506. The closure flap 500 may be selectively coupled to the back panel 200 by the fastener pad 260 and the fastener pad 504.

Referring to FIGS. 1 and 12, the inlet edge 336 defines a portion of the inlet 32. A cover 340 extends along the edge of the inlet 32, and a seam couples the cover 340 to the palm panel 100, the back panel 200, and the thumb panel 300. The cover 340 may reduce wear on these panels (e.g., due to repeatedly taking the glove 10 on and off). In other embodiments, the cover 340 is omitted.

Glove Cut Resistance

Some tasks, such as opening packages, require workers to handle sharp objects (e.g., tools). When opening packages, a sharpened tool (e.g., a box cutter) is used to cut a retaining material (e.g., tape) to permit access to objects within the packages. Commonly, workers are required to work for extended periods of time to open large quantities of packages. When working for extended periods of time, the workers may begin to exercise less caution regarding the use of the tool, increasing the probability that a user will handle the tool improperly and potentially experience an injury.

In some situations, a worker may rest their hand on top of a box (e.g., to prevent the box from sliding) while using a box cutter to cut tape holding the box closed. To cut the tape, the box cutter is moved across the surface of the box. If the worker's hand is improperly located or worker temporarily loses control of the box cutter (e.g., the blade of the box cutter slips out of the box), the blade may cross the users' thumb. This may lead to a variety of injuries, such as severing of the thumb tendon.

The glove 10 incorporates features that increase the cut resistance or other penetration resistance of the glove 10 relative to traditional gloves. By preventing a sharpened object from penetrating the glove 10, the glove 10 reduces the potential for injury in situations where a sharpened object would otherwise come into contact with a user's hand. In some embodiments, the improved cut resistance is focused on areas near the thumb of the user, as these areas may be relatively more prone to injury than other areas of the hand.

In some embodiments, the thumb panel 300 is made from a material having a high cut resistance. In some embodiments, the glove 10 utilizes multiple different materials. The cut resistance of the material of the thumb panel 300 may be greater than the cut resistance of the material(s) of one or more (e.g., all) of the other panels. By way of example, the cut resistance of the thumb panel 300 may be greater than the cut resistance of the palm panel 100 and the back panel 200. In some embodiments, the cut resistant material of the thumb panel 300 may be more costly than the materials used in the other panels. Additionally, the cut resistant material may trap more heat in the glove 10 than the materials used in the other panels. By using multiple different materials, the glove 10 is able to improve the cut resistance in areas where the most injury-prone portion of the user's hand resides (e.g., the thumb) while utilizing more cost-efficient and less insulative materials in areas of lower risk. Accordingly, the glove 10 provides a high degree of safety at a relatively low cost and with a relatively high degree of user comfort. In other embodiments, the entirety of the glove 10 is made from a cut resistant material.

As utilized herein, the term "penetration resistance" means a resistance of a material to movement of another object therethrough. Examples of penetration include puncturing (e.g., by a needle), cutting (e.g., by a knife or other sharp object), and tearing. The penetration resistance of each material may be defined in accordance with one or more standards (e.g., as dictated by one or more governing bodies). Such standards may include EN ISO 13997, ANSI/ISEA 2016, EN 388, or other standards. The penetration resistance may include one or more of a cut resistance, a tear strength, or a puncture resistance.

Figure 19:
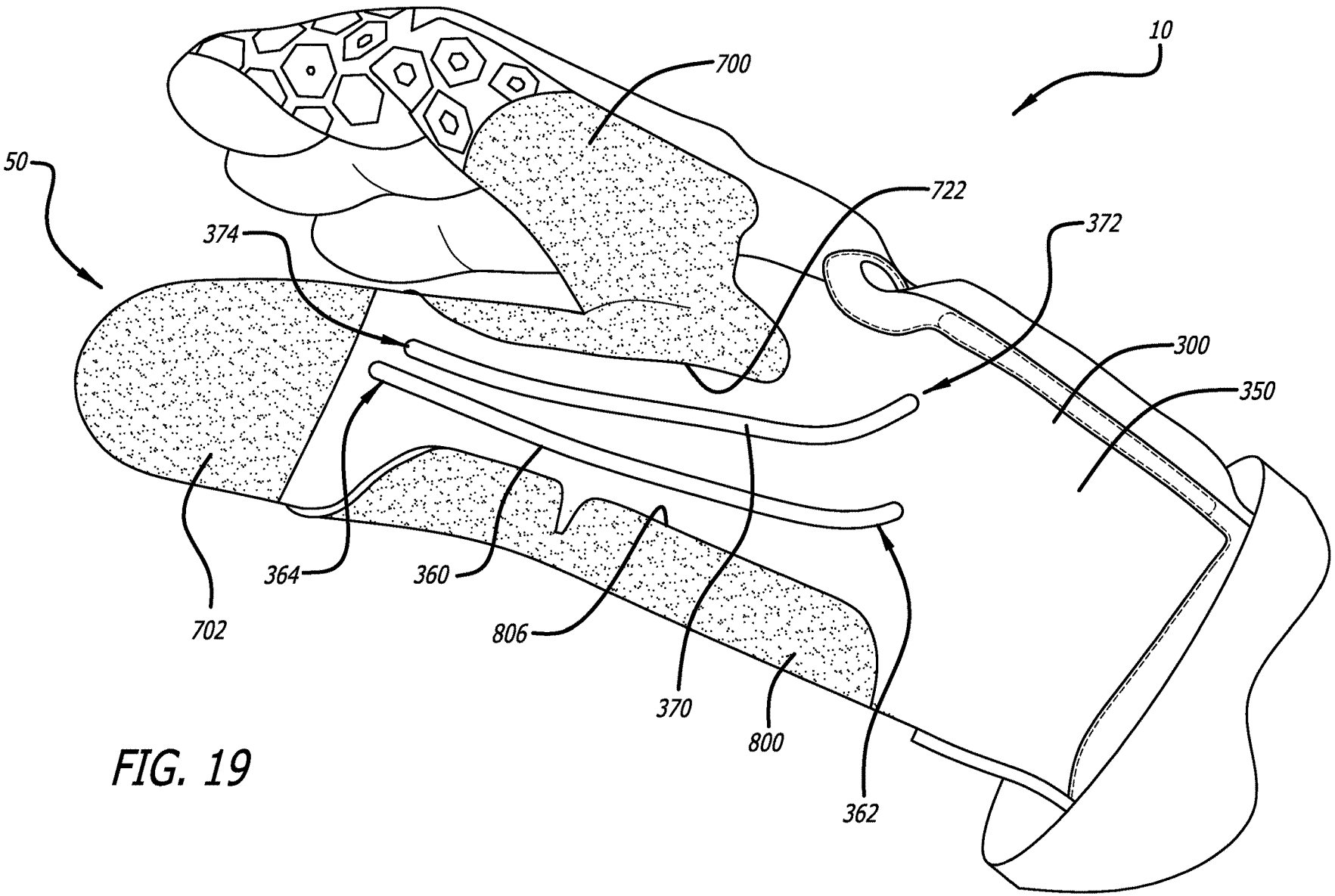
FIG. 19 is a top, left perspective view of the glove of FIG. 1.

Referring to FIGS. 12 and 19, the thumb panel 300 has an exterior or outer surface 350 opposite the volume contained by the glove 10. The outer surface 350 is generally relatively flat. The thumb panel 300 includes a pair of protrusions, folds, creases, or crimps, shown as pleat 360 and pleat 370, extending outward from the outer surface 350. When a sharpened object moves laterally across the thumb 50, the pleats 360, 370 reduce contact between the sharpened object and the outer surface 350 (e.g., reduce the amount of time that they are in contact, reduce the pressure with which the sharpened object contacts the outer surface 350, etc.), increasing the cut resistance of the glove 10.

The pleat 360 extends longitudinally along the length of the thumb 50 from a first end, shown as proximal end 362, to a second end, shown as distal end 364. The proximal end 362 is positioned between the base joint A and the middle joint B. The distal end 364 is positioned between the middle joint B and the distal joint C. Accordingly, the pleat 360 extends longitudinally across the middle joint B.

The pleat 370 extends longitudinally along the length of the thumb 50 from a first end, shown as proximal end 372, to a second end, shown as distal end 374. The proximal end 372 is positioned between the base joint A and the middle joint B. The distal end 374 is positioned between the middle joint B and the distal joint C. Accordingly, the pleat 370 extends longitudinally across the middle joint B.

As shown in FIGS. 12 and 19, a lateral distance between the proximal ends 362, 372 is greater than a lateral distance between the distal ends 364, 374. Accordingly, the pleat 360 and the pleat 370 are angled relative to one another (e.g., such that the angle opens toward the wrist of the user). As shown, a length of the pleat 360 is approximately equal to a length of the pleat 370. As shown, the pleat 360 and the pleat 370 are approximately symmetrically arranged about a longitudinal centerline of the thumb panel 300. In other words, the pleat 360 and the pleat 370 are collectively approximately laterally centered on the thumb panel 300. As shown in FIG. 19, the pleat 360 and the pleat 370 extend between the exposed edge 722 of the crotch reinforcement panel 700 and the exposed edge 806 of the rest reinforcement panel 800.

Figure 20A:
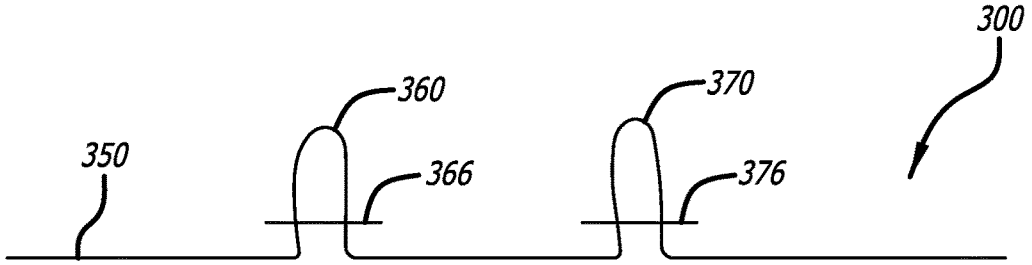
FIGS. 20A-20D are side section views of pleats of a thumb panel of a glove, according to various exemplary embodiments.

FIG. 20A is a cross-sectional view of the thumb panel 300 taken perpendicular to the length of the pleat 360. As shown, each pleat 360, 370 is formed by compressing the material of the thumb panel 300 laterally such that the material bunches and extends above the outer surface 350. Accordingly, the pleats 360, 370 are continuous with the remainder of the thumb panel 300. The pleats 360, 370 are retained in this bunched configuration by forming a seam along the length of each pleat. In the embodiment shown, the seam includes thread 366 sewn through the pleat 360 and thread 376 sewn through the pleat 370. As shown, the thread 366 passes laterally through the pleat 360 above the outer surface 350. The thread 366 does not penetrate the outer surface 350. Accordingly, the pleat 360 is in a generally upright orientation and is generally symmetrical about a vertical plane (e.g., in a center position). The pleat 360 may be deflected to the side (e.g., when pressed by a user or an object), but is generally biased to return to this center position by tension within the material of the thumb panel 300. The thread 376 causes the pleat 370 to have a similar configuration.

When a sharpened object is drawn across the thumb 50 in a lateral direction, the pleats 360, 370 provide multiple benefits. Because the pleats 360, 370 extend above the outer surface 350, the sharpened object is likely to contact the pleats 360, 370 prior to contacting the outer surface 350. This may entirely prevent the sharpened object from coming into contact with the outer surface 350, or may at least reduce the pressure that the sharpened object exerts on the outer surface 350. This effectively increases the thickness of the material that the sharpened object would have to cut through prior to reaching the user's hand. This is desirable over simply increasing the thickness of the thumb panel 300 generally, as increasing the thickness of the thumb panel 300 across the whole surface would increase the amount of material required, thus increasing the weight and the cost and reducing the flexibility of the thumb 50. Instead, the pleats 360, 370 do not increase the weight or the material costs, and may have a minimal (e.g., a negligible) impact on flexibility of the thumb 50.

Additionally, the pleats 360, 370 each form a sort of ramp oriented away from the outer surface 350. When a sharpened object moves across one of the pleats 360, 370, the pleat deflects the sharpened object outward, away from the outer surface. By including multiple pleats, the sharpened object is repeatedly deflected outward and may clear the entire width of the thumb 50 having had minimal (e.g., no) contact with the outer surface 350.

The pleats 360, 370 may cooperate with the crotch reinforcement panel 700 and the rest reinforcement panel 800 to further increase the cut resistance of the glove 10. The crotch reinforcement panel 700 and the rest reinforcement panel 800 extend above the outer surface 350. Because the crotch reinforcement panel 700 and the rest reinforcement panel 800 extend longitudinally on opposite sides of the pleats 360, 370, the crotch reinforcement panel 700 and the rest reinforcement panel 800 can engage the sharpened object, reducing contact between the sharpened object and the outer surface 350.

Figure 20B:
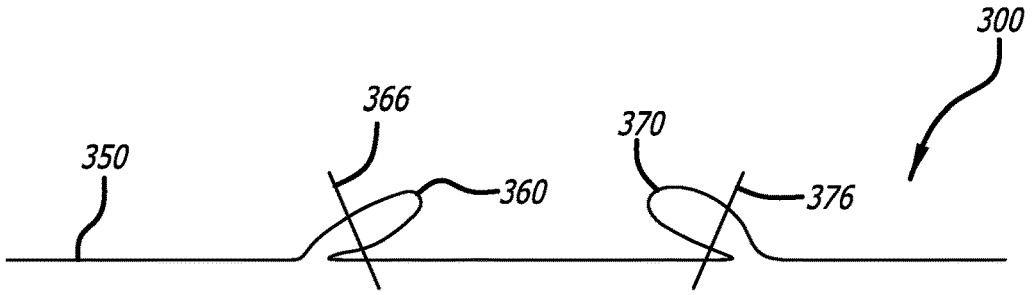
Figure 20C:
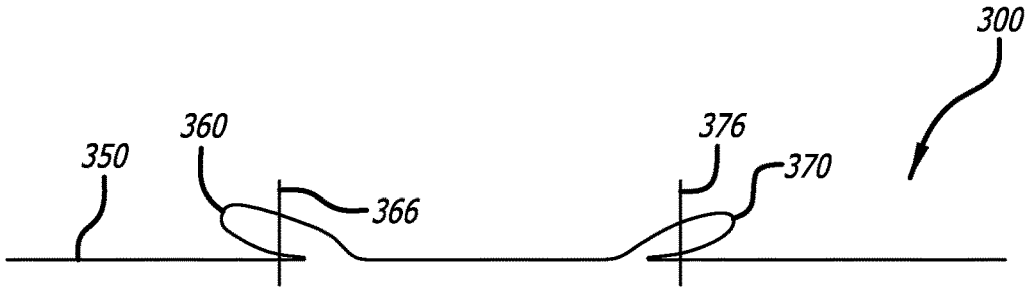
Figure 20D:
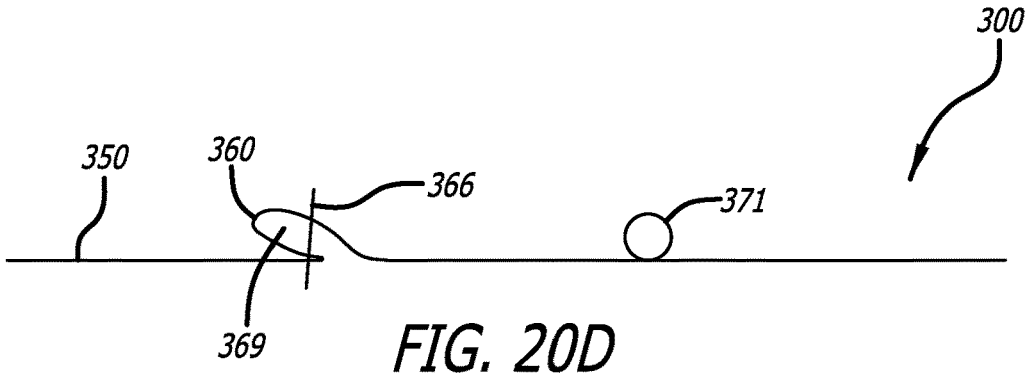

FIGS. 20B-20D illustrate various alternative arrangements of the pleats 360, 370. As shown in FIG. 20B, the thread 366 extends in a generally vertical direction, piercing through the outer surface 350. Specifically, the thread 366 pierces the outer surface 350 to the right of the base of the pleat 360. Accordingly, the thread 366 holds the pleat 360 down such that it extends in a generally rightward direction. The thread 376 similarly extends vertically through the outer surface 350. The thread 376 pierces the outer surface 350 to the left of the base of the pleat 370 such that the pleat 370 extends in a generally leftward direction. The embodiment of FIG. 20C is similar to the embodiment of FIG. 20B except (a) the pleat 360 extends in a generally leftward direction and (b) the pleat 370 extends in a generally rightward direction.

In the embodiment of FIG. 20D, the pleat 360 contains a filler material (e.g., plastic, metal, fabric, etc.), shown as filler 369. The filler 369 may be an elongated rod that extends along the length of the pleat 360. The filler 369 may modify the response of the pleat 360 to different input forces. By way of example, the filler 369 may resist bending of the pleat 360. By way of example, the filler 369 may resist rotation of the pleat 360 (e.g., away from a default position). The filler 369 may be contained within the pleat 360 by the thread 366. The filler 369 is shown with a solid circular cross section. In other embodiments, the filler 369 is tubular and/or has a different cross-sectional shape.

In the embodiment of FIG. 20D, the pleat 370 is replaced with a longitudinal protrusion, shown as protrusion 371. The protrusion 371 is approximately the same size as the pleat 370 and extends along the same path as the pleat 370 (e.g., occupies the same space that is occupied by the pleat 370 in other embodiments). Instead of being formed as part of the thumb panel 300, the protrusion 371 is separately formed and subsequently coupled to the thumb panel 300. The protrusion 371 may be made from a variety of different materials (e.g., fabric, metal, plastic, etc.). The protrusion 371 may be coupled to the thumb panel 300 using a variety of different methods (e.g., using adhesive, using a fastener such as staples, using stitching, etc.). The protrusion 371 may perform a similar function to that of the pleat 370.

FIGS. 21A-21F illustrate various alternative arrangements of the thumb panel 300. In FIG. 21A, the thumb panel 300 includes four pleats: the pleat 360, the pleat 370, a pleat 380, and a pleat 390. The pleats are substantially evenly spaced, substantially straight, and substantially parallel to one another. In other embodiments, a lateral spacing between pleats adjacent may be varied. In other embodiments, the pleats may be curved. In other embodiments, pleats may extend at an angle to one another.

In FIG. 21B, the thumb panel 300 includes the pleat 360 and the pleat 370. The pleat 360 and the pleat 370 are substantially straight and extend at an angle to one another. The pleat 360 and the pleat 370 have approximately the same length.

In FIG. 21C, the thumb panel 300 includes the pleat 360, the pleat 370, the pleat 380, and the pleat 390. In this arrangement, the pleats increase in length from left to right. Additionally, the proximal ends 362, 372, 382, 392 of the pleats all have different longitudinal positions. In other embodiments, the longitudinal locations of the pleats may be varied.

In FIG. 21D, the thumb panel 300 includes the pleat 360 and the pleat 370. The pleat 360 and the pleat 370 are both curved. As shown, both pleats have approximately the same radius of curvature and are concave in the same direction. In other embodiments, the pleats have different curvatures (e.g., shapes, radii of curvature, concavities, etc.).

In FIG. 21E, the thumb panel 300 includes the pleat 360 and the pleat 370. The pleat 360 and the pleat 370 are connected by an intervening pleat, shown as middle pleat 391. In other embodiments, more or fewer intervening pleats may connect various pleats (e.g., at one or both ends).

In FIG. 21F, the thumb panel 300 includes the pleat 360, the pleat 370, the pleat 380, and the pleat 390. The pleat 360 is laterally aligned with the pleat 380 and longitudinally offset from the pleat 380. A longitudinal gap is formed between the pleat 360 and the pleat 380. The pleat 370 is laterally aligned with the pleat 390 and longitudinally offset from the pleat 390. A longitudinal gap is formed between the pleat 370 and the pleat 390.

Figure 22:
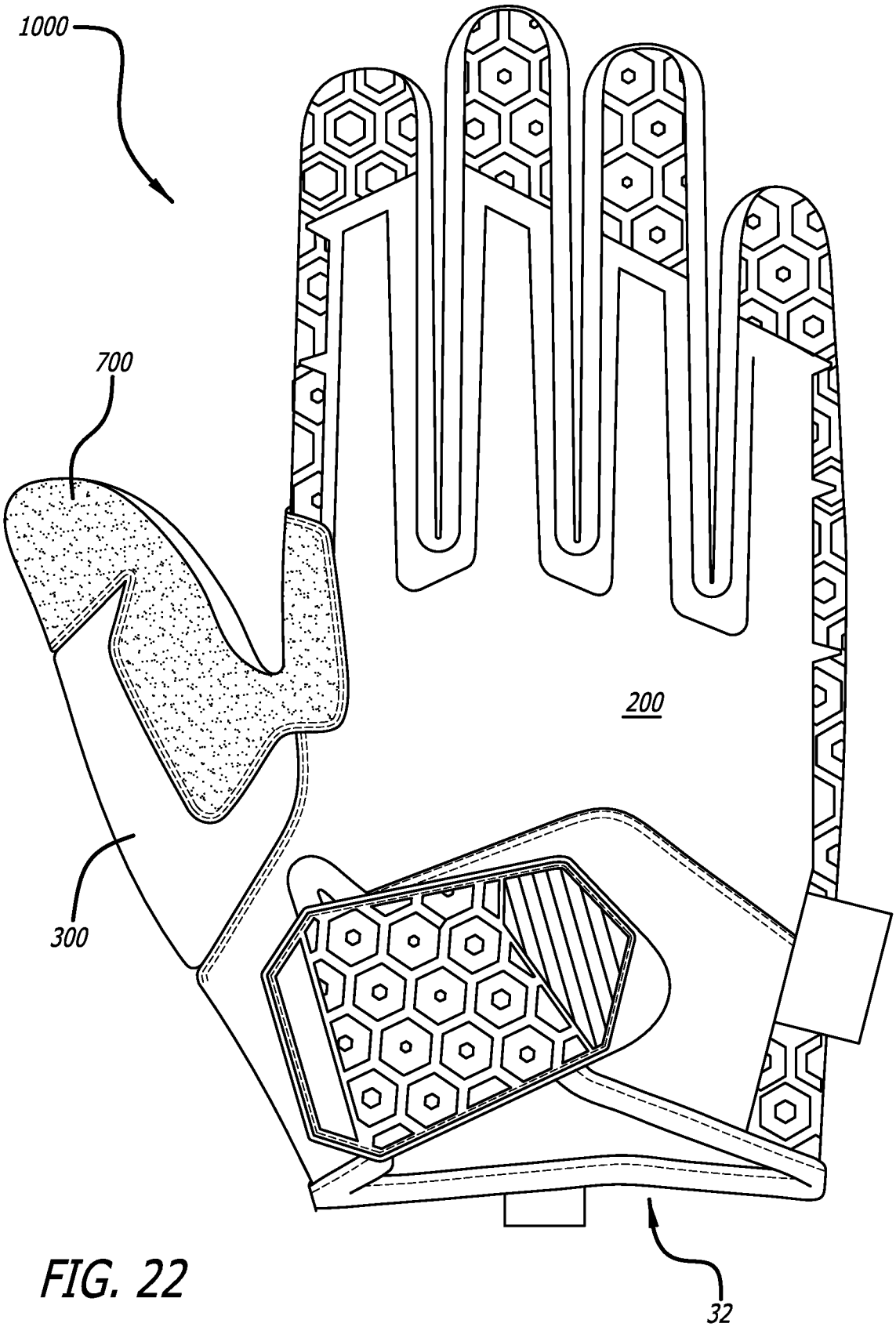
FIG. 22 is a top view of a glove, according to an exemplary embodiment.
Figure 23:
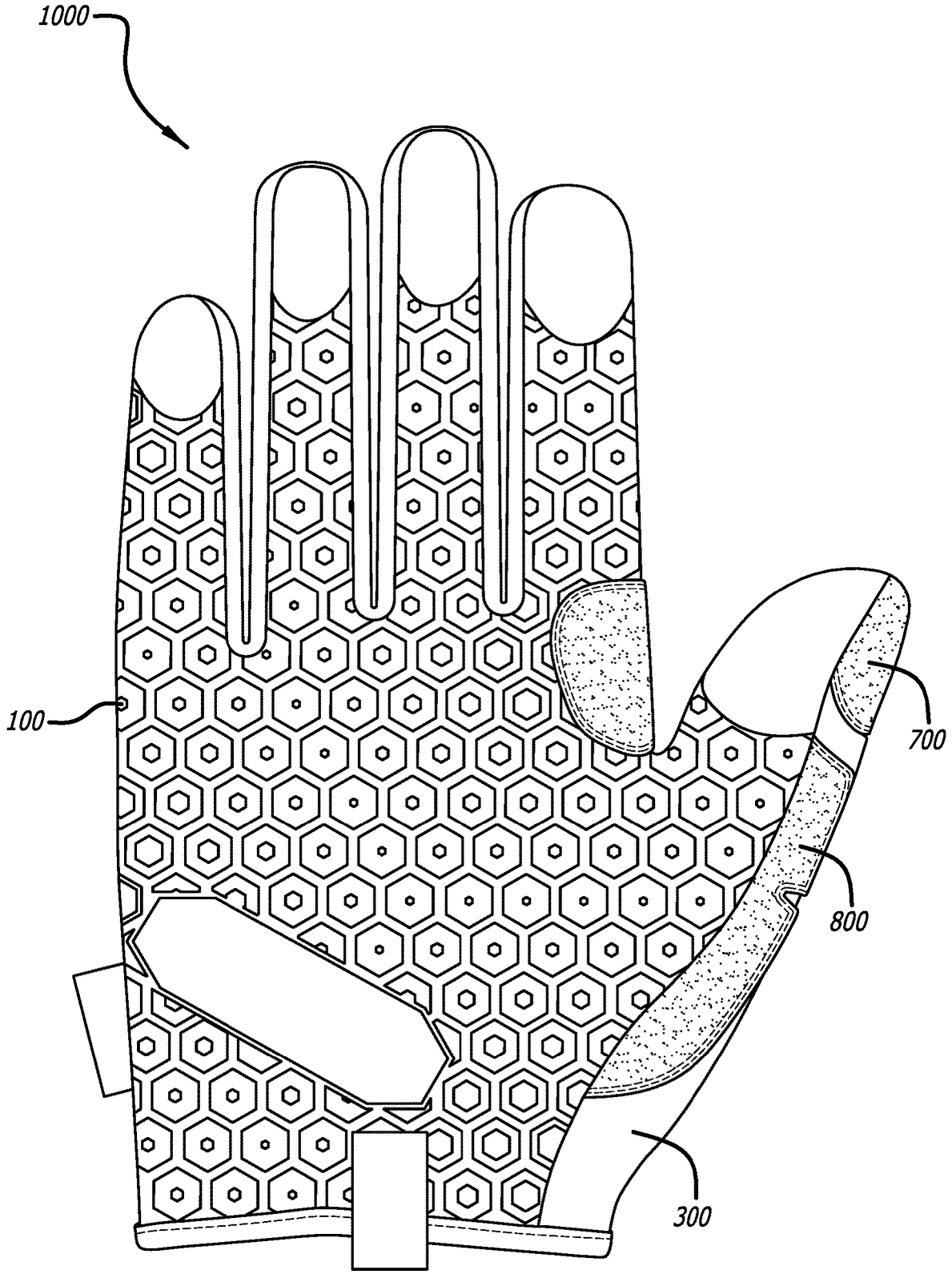
FIG. 23 is a bottom view of the glove of FIG. 22.

FIGS. 22 and 23 illustrate an alternative embodiment of a glove, shown as glove 1000. The glove 1000 may be substantially similar to the glove 10, except as otherwise specified herein. In this embodiment, the thumb panel 300 does not extend the entire distance to the inlet 32 on the top surface. Instead, the back panel 200 extends between the thumb panel 300 and the inlet 32.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the Figures. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the glove as shown in the various exemplary embodiments is illustrative only. Additionally, any element disclosed in one embodiment may be incorporated or utilized with any other embodiment disclosed herein. For example, the thumb panel 300 of the exemplary embodiment shown in at least FIG. 21A may be incorporated in the glove 10 of the exemplary embodiment shown in at least FIG. 1. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A glove for protecting a hand of a user, comprising:

a main glove body configured to receive metacarpals of the hand;

a glove thumb coupled to the main glove body and extending longitudinally away from the main glove body, wherein the glove thumb is configured to receive a thumb of the hand, and wherein the glove thumb includes a thumb panel extending longitudinally along a length of the glove thumb;

a crotch reinforcement panel coupled to the thumb panel and the main glove body, wherein the crotch reinforcement panel extends along at least a first portion of the glove thumb and a portion of the main glove body;

a rest reinforcement panel coupled to the thumb panel, wherein the rest reinforcement panel extends along at least a second portion of the thumb panel; and wherein the thumb panel forms a first pleat including compressed material of the thumb panel, the first pleat raised above an outer surface of the thumb panel, and wherein the first pleat extends longitudinally along the length of the glove thumb, wherein the thumb panel forms a second pleat raised above the outer surface of the thumb panel, and wherein the second pleat extends longitudinally along the length of the glove thumb, and wherein the first pleat and the second pleat extend between the crotch reinforcement panel and the rest reinforcement panel and are laterally centered on the thumb panel.

2. The glove of claim 1, wherein the glove thumb is configured to receive a first joint that connects a metacarpal of the thumb to a proximal phalanx of the thumb, and wherein the first pleat and the second pleat are configured to extend longitudinally across the first joint when the glove is worn by the hand.

3. The glove of claim 2, wherein the thumb panel is configured to extend along a second joint that connects a metacarpal of the thumb to carpals of the hand, and wherein a proximal end of the first pleat is configured to be positioned between the first joint and the second joint when the glove is worn by the hand.

4. The glove of claim 2, wherein a distal end of the first pleat and a distal end of the second pleat are longitudinally offset from a fingertip of the glove thumb.

5. The glove of claim 1, wherein the main glove body includes a panel coupled to the thumb panel, wherein the panel of the main glove body is made from a first material, and wherein the thumb panel is made from a second material that has a greater cut resistance than the first material.

6. The glove of claim 5, wherein the panel of the main glove body is a palm panel configured to extend along a palm of the hand when the glove is worn by the hand.

7. The glove of claim 5, wherein the panel of the main glove body is a back panel configured to extend along a back side of the hand when the glove is worn by the hand.

8. The glove of claim 1, wherein the thumb panel is configured to extend continuously from (a) a joint that connects a metacarpal of the thumb to carpals of the hand to (b) a fingertip of the glove thumb when the glove is worn by the hand.

9. A glove for protecting a hand of a user, comprising:

a main glove body configured to receive metacarpals of the hand;

a glove thumb coupled to the main glove body and extending longitudinally away from the main glove body, wherein the glove thumb is configured to receive a thumb of the hand, and wherein the glove thumb includes a thumb panel extending longitudinally along a length of the glove thumb, wherein the main glove body includes a panel coupled to the thumb panel, wherein the panel of the main glove body is made from a first material, and wherein the thumb panel is made from a second material that has a greater cut resistance than the first material;

a crotch reinforcement panel coupled to the thumb panel and the main glove body, wherein the crotch reinforcement panel extends along at least a first portion of the glove thumb and a portion of the main glove body;

a rest reinforcement panel coupled to the thumb panel, wherein the rest reinforcement panel extends along at least a second portion of the thumb panel; and a plurality of protrusions coupled to the thumb panel, wherein:

the protrusions are raised above an outer surface of the thumb panel, extend longitudinally along the length of the glove thumb between the crotch reinforcement panel and the rest reinforcement panel, and are angled relative to one another so that a lateral distance between proximal ends of the protrusions is greater than a lateral distance between distal ends of the protrusions.

10. The glove of claim 9, wherein the panel of the main glove body is a palm panel configured to extend along a palm of the hand when the glove is worn by the hand.

11. The glove of claim 9, wherein the panel of the main glove body is a back panel configured to extend along a back side of the hand when the glove is worn by the hand.

12. The glove of claim 9, wherein the panel of the main glove body is coupled to the thumb panel along a seam, and wherein the crotch reinforcement panel covers at least a portion of the seam.

13. The glove of claim 9, wherein the panel of the main glove body is coupled to the thumb panel along a seam, and wherein the crotch reinforcement panel extends into the seam to couple the crotch reinforcement panel to the thumb panel.

14. The glove of claim 9, wherein the glove thumb is configured to receive a first joint that connects a metacarpal of the thumb to a proximal phalanx of the thumb, and wherein the thumb panel is configured to extend longitudinally across the first joint when the glove is worn by the hand.

15. The glove of claim 14, wherein the thumb panel is configured to extend longitudinally to a fingertip of the glove thumb when the glove is worn by the hand.

16. The glove of claim 15, wherein the thumb panel is configured to extend continuously from (a) a joint that connects the metacarpal of the thumb to carpals of the hand to (b) the fingertip of the glove thumb when the glove is worn by the hand.

* * * * *